US005870654A

United States Patent [19]

Sato et al.

[11] Patent Number: 5,870,654

[45] Date of Patent: Feb. 9, 1999

[54] PROCESS CARTRIDGE REMANUFACTURING METHOD AND PROCESS CARTRIDGE

[75] Inventors: Minoru Sato, Yokohama; Kazuyoshi Odagawa, Koshigaya; Hiroo Kobayashi, Yokohama; Shinichi Sasaki, Fujisawa; Satoshi Kurihara, Yokohama, all of Japan

[73] Assignee: Canon Kabushiki Kaisha, Tokyo, Japan

[21] Appl. No.: 925,777

[22] Filed: Sep. 9, 1997

Related U.S. Application Data

[63] Continuation of Ser. No. 443,576, May 17, 1995, abandoned.

[30] Foreign Application Priority Data

May 19, 1994 [JP] Japan ..... 6-105641

[51] Int. Cl.[6] ..... G03G 15/00

[52] U.S. Cl. ..... 399/109; 399/110; 399/111; 399/113

[58] Field of Search ..... 355/210, 200, 355/211, 260; 399/109, 110, 111, 113, 115–117, 119, 123, 120

[56] References Cited

U.S. PATENT DOCUMENTS

| | | | |
|---|---|---|---|
| 4,816,877 | 3/1989 | Keen . | |
| 4,862,210 | 8/1989 | Woolley . | |
| 4,873,548 | 10/1989 | Kobayashi et al. | 355/200 |
| 4,930,684 | 6/1990 | Patterson | 222/325 |
| 5,080,745 | 1/1992 | Paull | 156/247 |
| 5,110,646 | 5/1992 | Prestel et al. | 428/43 |
| 5,184,182 | 2/1993 | Michlin . | |
| 5,221,943 | 6/1993 | Hasegawa | 355/200 X |
| 5,223,068 | 6/1993 | Baley | 156/250 |
| 5,223,893 | 6/1993 | Ikemoto et al. | 355/200 |
| 5,267,003 | 11/1993 | Grappiolo . | |
| 5,294,960 | 3/1994 | Nomura et al. | 355/210 |
| 5,296,902 | 3/1994 | Michlin . | |
| 5,729,795 | 3/1998 | Kavolius et al. | 399/109 |
| 5,781,831 | 7/1998 | Matsuzaki et al. | 399/119 |

FOREIGN PATENT DOCUMENTS

| | | |
|---|---|---|
| 0485271 | 5/1992 | European Pat. Off. . |
| 0631207A | 12/1994 | European Pat. Off. . |
| 58-21262 | 2/1983 | Japan . |
| 4-136866 | 5/1992 | Japan . |
| 4-139462 | 5/1992 | Japan . |
| 4-293066 | 10/1992 | Japan . |
| 4-309967 | 11/1992 | Japan . |
| 5-80601 | 4/1993 | Japan . |
| 6-130740 | 5/1994 | Japan . |

*Primary Examiner*—Matthew S. Smith
*Attorney, Agent, or Firm*—Fitzpatrick, Cella, Harper & Scinto

[57] ABSTRACT

A process cartridge remanufacturing method for a process cartridge detachably mountable to a main assembly of an image forming apparatus includes the steps of providing a new photosensitive drum; providing a new toner-development frame including a new toner frame having a toner containing portion for containing toner, a new development frame having a roller mounting portion for mounting a developing roller for supplying toner to the photosensitive drum, wherein the toner frame and the development frame are welded with a new removable toner seal therebetween for preventing the toner in the toner containing portion from leaking out; preparing a drum frame to be reused having a drum mounting portion for mounting the photosensitive drum; supplying toner into the toner containing portion; mounting the developing roller to the new development frame; mounting the photosensitive drum to the drum frame to be reused; and rotatably engaging the new toner-development frame and the drum frame to be reused.

54 Claims, 27 Drawing Sheets

PROCESS CARTRIDGE REMANUFACTURING METHOD AND PROCESS CARTRIDGE

This application is a continuation of application Ser. No. 08/443,576, filed May 17, 1995, now abandoned.

FIELD OF THE INVENTION

The present invention relates to a process cartridge and an image forming apparatus, into or from which a process cartridge is installable or removable.

This image forming apparatus includes electro-photographic copying machines, electro-photographic printers (for example, LED printers, laser beam printers, or the like), electro-photographic facsimile apparatuses, electro-photographic word processors, or the like.

As for the process cartridge, it is such a cartridge that integrally comprises: a combination of charging means, developing means, cleaning means, and/or an electro-photographic photosensitive member; a combination of at least one of the charging means, developing means, and cleaning means, and the electro-photographic photosensitive member; or a combination of at least the developing means and electro-photographic photosensitive member, and can be removably installed into the main assembly of the image forming apparatus.

DESCRIPTION OF THE RELATED ART

In a conventional image forming apparatus employing the electro-photographic image forming process, a process cartridge system is used in which the electro-photographic photosensitive member and the processing means that acts on the electro-photographic photosensitive member are integrated into a form of cartridge, which can be removably installed into the main assembly of the image forming apparatus. According to this cartridge system, the apparatus can be maintained by a user him/herself without relying on professional maintenance personnel; therefore, the operational efficiency can be substantially increased. Thus, this process cartridge system has been widely employed in image forming apparatus.

A remanufacturing method for such a process cartridge has been known to comprise a step for disassembling the process cartridge into a frame A and a frame B, and a step for uniting again the frames A and B (U.S. Pat. No. 5,294,960), wherein the frame A comprises a photosensitive drum, and the frame B comprises developing means and developer storing means.

The method disclosed in the aforementioned patent is one of the effective remanufacturing methods for a process cartridge.

The present invention is an invention made by developing further the aforementioned prior technology.

SUMMARY OF THE INVENTION

A primary object of the present invention is to provide a remanufacturing method for a process cartridge and a remanufactured process cartridge.

Another object of the present invention is to provided a remanufacturing method for a process cartridge from which no toner is liable to leak while it is in use, and a cartridge remanufactured by such a method.

A further object of the present invention is to provide a remanufacturing method for a process cartridge capable of offering high image quality during its repeated usage, and a cartridge remanufactured by such a method.

Another object of the present invention is to provide a remanufacturing method for a process cartridge which is not liable to leak the toner, and is capable of offering high image quality during repeated usage, and a process cartridge remanufactured by such a method.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 24(*b*) is a sectional view of the same, taken along a line A, and shows the operation of an oscillating table.

DESCRIPTION OF THE PREFERRED EMBODIMENTS

Figure 1:
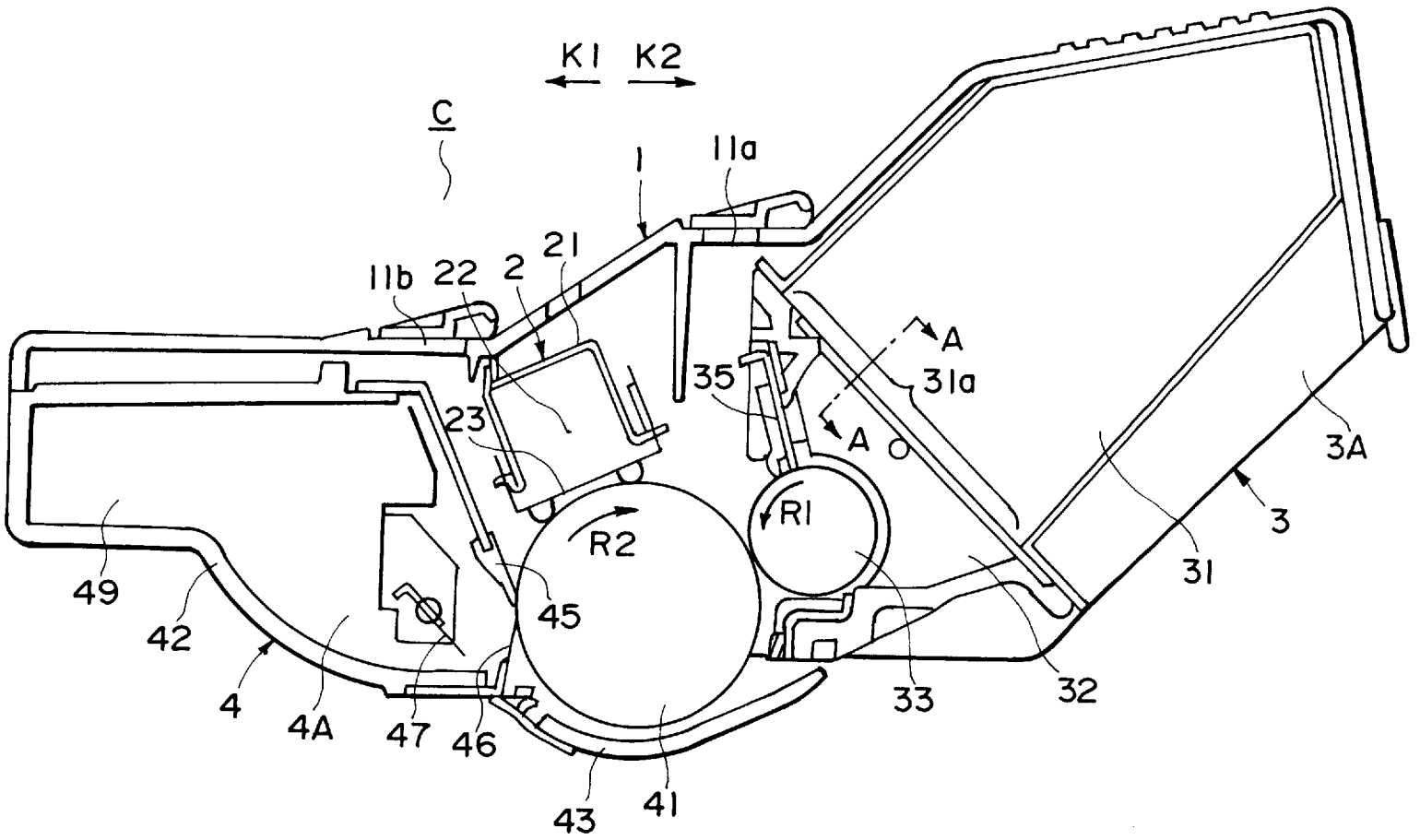
FIG. 1 is a vertical sectional view of a process cartridge.

Hereinafter, the preferable embodiments of the present invention will be described.

The process cartridge, which will be described hereinafter, comprises a given combination of: a toner chamber frame (T frame) provided with a toner storing portion; a developing chamber frame (D frame), on which a developing roller or the like is mounted; and a drum frame, on which a photosensitive drum, a cleaning member, and the like are mounted. When a cartridge of this type is assembled, the openings of the toner chamber frame are sealed with sealing members so that the toner stored within the toner chamber frame is prevented from leaking out, and then, the toner chamber frame and developing chamber frame are melt-welded to form a T chamber-D chamber combination frame (T-D frame). When it is put to use, an operator takes hold of the portion of the sealing member exposed from the gap between the T frame and D frame, and pulls out the sealing member to allow the toner within the T frame to be supplied to the developing roller.

In the first embodiment of the present invention, which will be described next, it will be described how a replaceable process cartridge for an image forming apparatus is remanufactured.

This embodiment of the remanufacturing method involves: a new photosensitive drum; a recycled drum frame, on which the new photosensitive drum is mounted; a new T frame containing the toner storing portion for storing the toner; a new D frame containing a roller mount portion for mounting a developing roller that supplies the toner to the photosensitive drum; and a new toner sealing member. The method includes a step in which the toner is stored in the toner storing portion provided in the new T frame; a step in which the developing roller is mounted in the new D frame; a step in which the photosensitive drum is mounted in the recycled drum frame, and a step in which two frames, that is, T and D frames, are joined to form a new T-D frame, with the toner sealing member being removably interposed between two frames in such a manner that the toner stored in the toner storing portion is prevented from leaking; and a step in which the new T-D frame and recycled drum frame are joined so as to be pivotal from each other.

"The recycled drum frame" mentioned above means a drum to be recycled.

In recycling the process cartridge, a new T-D frame is used; therefore, the T frame and D frame can be joined after the toner sealing member is attached to seal completely the opening of the T frame. As a result, the toner leak from the toner storing portion can be completely prevented.

Hereinafter, the preferable embodiments of the present invention will be more specifically described referring to the drawings.

{Overall Structures of Process Cartridge and Image Forming Apparatus}

Before beginning the detailed description of the present invention, descriptions will be given as to the general structure of the process cartridge in which a photosensitive drum and a cleaning blade are mounted, and the general structure of a laser beam printer (image forming apparatus) in which the process cartridge is installed.

FIG. 1 is a vertical sectional view of a process cartridge C, and shows the general structure thereof. Generally speaking, the process cartridge C comprises four units separable from each other: a top unit (cartridge cover), a primary charging unit (charging means) 2, a developing unit (developing means) 3, a cleaning unit (cleaning means) 4. The developing unit 3 and cleaning unit 4 comprise, respectively, a T-D frame 3A and a drum frame 4A, which store or support structural components to be described later. It should be noted that when the process cartridge C is disassembled into these four units, the photosensitive drum (electro-photographic photosensitive drum) 41 is contained in the cleaning unit 4.

The top frame 1 is constituted of a frame that covers from above the primary charging unit 2, developing unit 3, and cleaning unit 4, and is provided with light passing holes 11*a* and 11*b* for allowing exposure light and reflected exposure light. These light passing holes 11*a* and 11*b* are cut in the vertical direction, substantially at the middle of the top frame 1 in the front-to-rear direction (direction of arrows K1 and K2 in FIG. 1).

The primary charging unit 2 has a U-shaped section, and comprises: a shield 21, the opening of which faces the photosensitive drum 41; a discharge wire 22 disposed within the shield 21; and a grid 23 disposed at the opening of the shield 21.

The developing unit 3 comprises: a toner chamber frame (T frame) 31 provided with a toner (developer) storing portion; a developing chamber frame (D frame) 32 provided with a developing chamber, which is in communication with the T frame 31 through an opening 31*a* provided on the T frame 31 and an opening 32*a* provided on the D frame 32; and a developing roller 33 mounted on the D frame 32 so as to face directly the photosensitive drum 41. Above the developing roller 33, a developing blade 35 for regulating the thickness of a layer of the toner coated on the surface of the developing roller 33 is disposed. An alphanumerical reference 32*f* designates a mount where the developing roller 33 is disposed, and the developing roller 33 is mounted on this mount 32*f*, using left and right arms 36*c* and 36*d*. An alphanumerical reference 32*g* designates an end seal, and 33*a* designates a gear.

The cleaning unit 4 supports the photosensitive drum 41 and cleaning apparatus 42. The photosensitive drum 41 is supported so as to be rotatable in the direction of an arrow mark R2, and below it, a protective plate (drum shutter) for protecting the photosensitive drum 41 from unnecessary exposure or physical damage is disposed. This protective plate 43 is retractively constructed, and is automatically retracted to expose the bottom portion of the photosensitive drum 41 as the process cartridge C is installed into the apparatus main assembly to be described later. The cleaning apparatus 42 comprises: an elastic cleaning blade (of urethane, for example) 45, which rubs the surface of the photosensitive drum 41 to remove the residual toner adhering thereto; a scooping sheet 46 for catching the residual toner scraped off by the cleaning blade 45; a waste toner delivery member 47, which moves toward the front (direction indicated by the arrow mark K1) the residual toner caught by the scooping sheet 46; and a waste toner storage 49 for storing the delivered residual toner.

Figure 2:
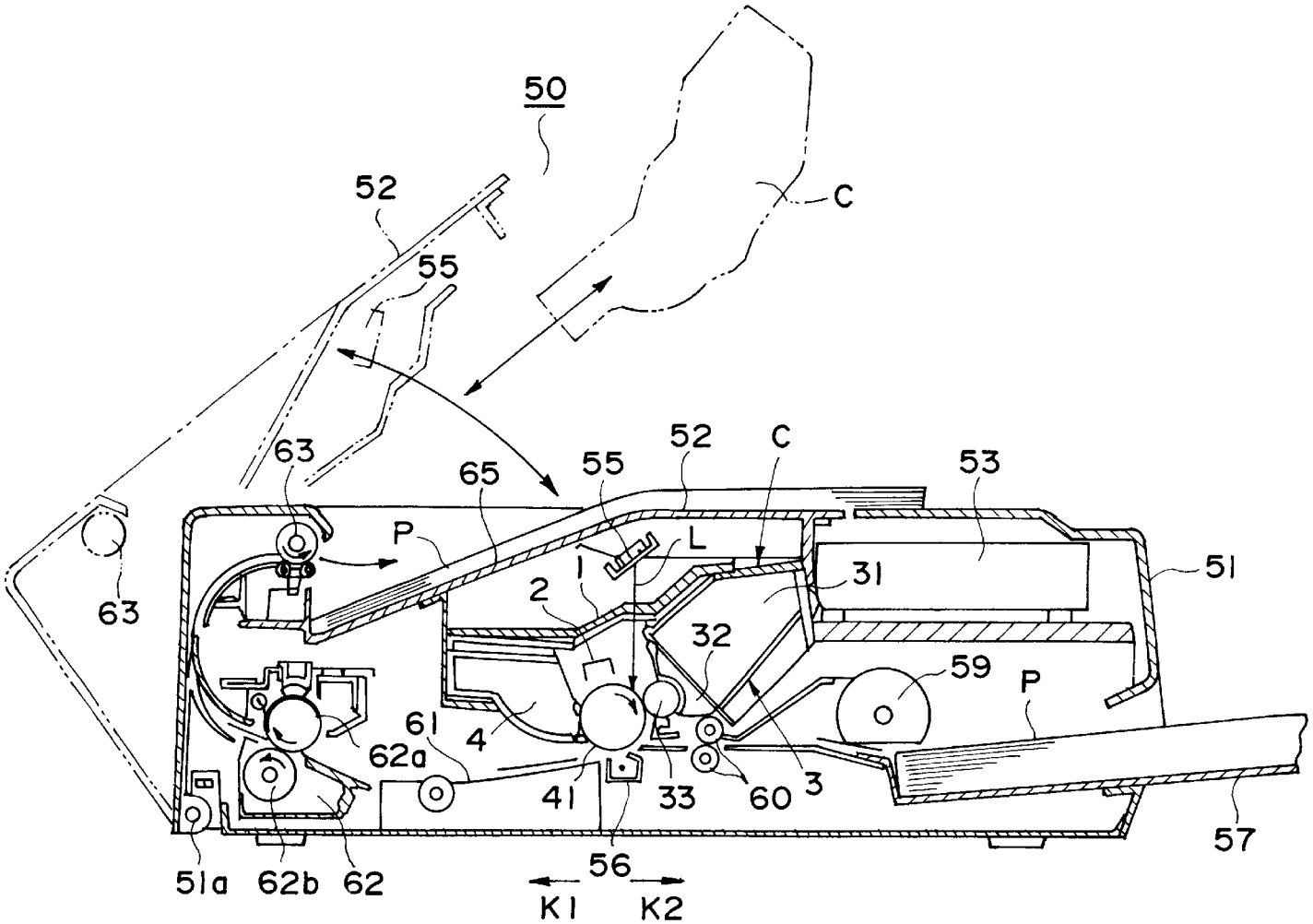
FIG. 2 is a vertical section of a laser beam printer, in which the process cartridge has been installed.

The process cartridge C constructed as described in the foregoing is installed into a laser beam printer 50 illustrated in FIG. 2. The laser beam printer 50 comprises an apparatus main assembly 51, and a cover 52 that is rotatable about a rotational axis 51*a* provided on the apparatus main assembly 51, at the bottom front (direction of the arrow mark K1). This cover 52 is normally closed (solid line in the drawing), and is opened (double dot chain line) when the process cartridge C is replaced, when a jam caused by a sheet of transfer medium P such as paper, on which an image is formed, is handled, or when a like situation occurs. When the process cartridge C is installed, it is first held in the open cover 52, and then, this cover holding the process cartridge C is closed, whereby the process cartridge C is disposed at a predetermined location (solid line in the drawing) within the apparatus main assembly 51. As the process cartridge C is disposed at the predetermined location, the photosensitive drum 41, developing roller 33, and the like are connected to the driving means (unillustrated) provided on the apparatus main assembly 51 side, being thereby rotatively driven in the directions of arrow marks R2 and R1 (refer to drawing), respectively. At this time, the discharge wire 22 of the primary charging unit 2, and the developing roller 33, are connected to the high voltage power source provided on the same apparatus main assembly 51 side.

Next, referring to FIGS. 1 and 2, an image forming process of the laser beam printer 50 will be described. As a command to start the image formation is sent in through a start button (unillustrated), the photosensitive drum 41 is rotatively driven in the arrow mark R2 direction, being thereby uniformly charged by the primary charging unit 2, on the surface thereof. The surface of the photosensitive drum 41 is exposed to an exposure light by an exposing means comprising a laser unit 53, a full-reflection mirror 55, and the like, whereby an electrostatic latent image reflecting the imaging data is formed. The electrostatic latent image turns into a toner image as the toner is adhered thereto by the developing roller 33 of the developing unit 3. The toner image formed on the photosensitive drum 41 is transferred onto a sheet of transfer medium P by a transferring apparatus 56. This transfer medium P is a sheet of transfer medium such as is stored in a sheet feeding cassette 57 installed in the rear side (direction of the arrow mark K2) of the apparatus main assembly 51, is fed by a sheet feeding roller 59, and then, is delivered by a registration roller pair 60 in synchronism with the rotation of the photosensitive drum 41. The transfer medium P having received the toner image is further conveyed along a delivery guide 61 to a fixing apparatus 62. In the fixing apparatus 62, the transfer medium P is subjected to heat and pressure by a fixing roller 62*a* and a pressing roller 62*b*, whereby the toner image is fixed to the surface of the transfer medium P. Thereafter, the transfer medium P, on which the toner image has been fixed, is discharged by a discharge roller 63 into a discharge tray 65 formed on the top surface of the cover 52.

{Remanufacturing Process of Process Cartridge}

Next, a case in which a used process cartridge C is recycled will be described. Generally, the used process cartridge is recovered from the market in cooperation with consumers. In this case, some of the members in the recovered process cartridge C must be replaced with new ones. The first member, which can listed as such, is the photosensitive drum 41, the photosensitive surface layer of which has deteriorated due to a long period of usage, and also, there are other members which must be replaced, since they have reached the ends of their service lives, or have been damaged by certain factors.

When the process cartridge C according to the present invention is replenished with the toner, or the aforementioned members thereof are replaced, it is first disassembled into four major units, and then, each of the four major units is further disassembled into smaller portions as needed.

(Disassembling Steps)

First, a step in which the process cartridge C is disassembled into the aforementioned major units, that is, the top frame 1, primary charging unit 2, developing unit 3, and cleaning unit 4, will be described.

To begin with, the process cartridge C to be disassembled is set within an air duct (unillustrated), in which air is blown on the surface of the process cartridge C to remove the toner or dust adhering to the surface thereof.

Figure 3:
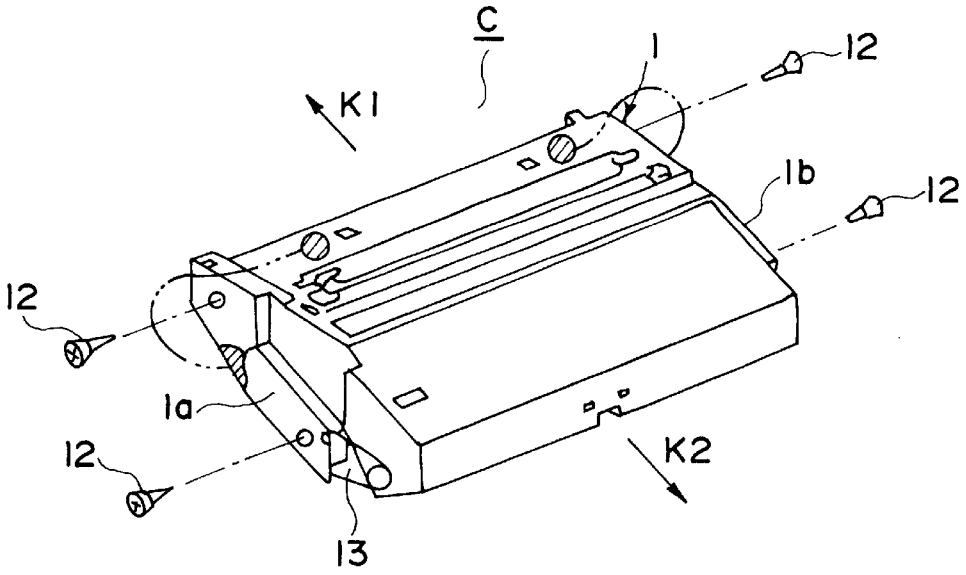
FIG. 3 is a perspective view of the process cartridge, from which pins have been removed.

Next, referring to FIG. 3, a total of four pins 12 (two on the left and two on the right), with which the left and right wall portions 1*a* and 1*b* (direction indicated by the arrow mark K1) are fixed to the cleaning unit 4, are removed. More specifically, the head portion of the pin 12 is in the form of a flange having a recess at the center, and this flange portion is gripped with a radio pliers and rotatively pulled out. The pin 12 is of resin material, and an engaging portion is provided at the end. However, when it is pulled out, the engaging portion and the flange portion gripped by the radio pliers are liable to be damaged; therefore, the pin 12 is replaced with a new one during the remanufacturing. Further, before the process cartridge C is put to use, a seal film cover 13 protecting a seal film (unillustrated) that seals the T frame 31 and D frame 32 is pulled off by the radio pliers, for example, in the same manner as the pin 12; therefore, the seal film cover 13 is also replaced with a new one during the remanufacturing.

Figure 4:
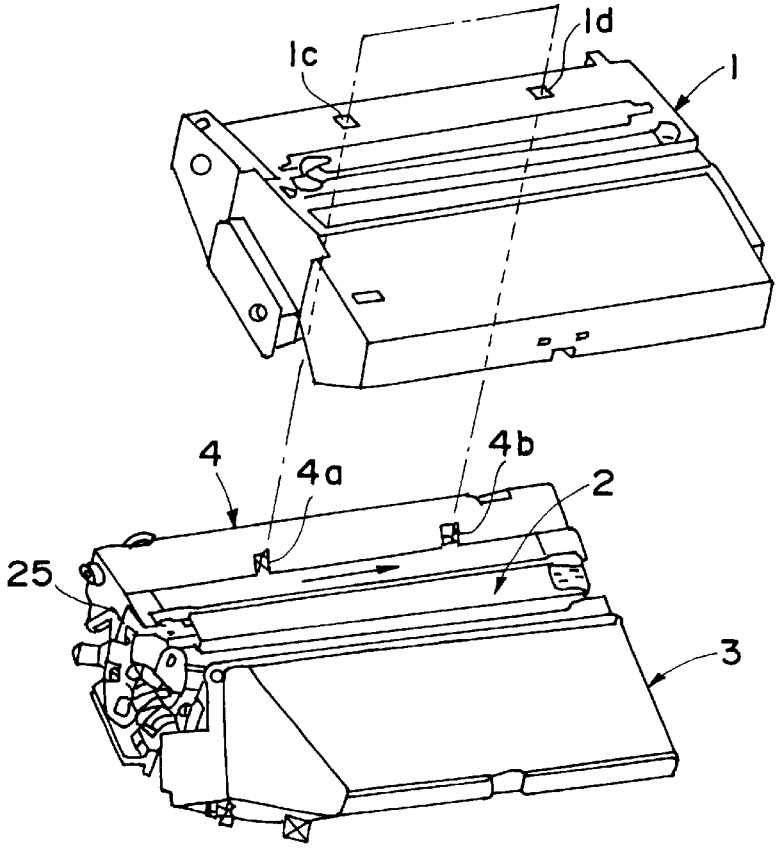
FIG. 4 is a perspective view of the process cartridge, with its top frame off.

Next, referring to FIG. 3, the top frame 1 is grabbed by the left and right hands, on the left and right ends (double dot chain line), with the left and right thumbs placed at a couple of hatched areas, respectively. While the hatched areas are pressed down, the left and right wall portions 1*a* and 1*b* of the top frame 1 are lift up with the fingers placed at other hatched areas (only one of the other hatched areas is illustrated) as if the left and right wall portions 1*a* and 1*b* are opened outward from the bottom, respectively. As a result, claws 4*a* and 4*b*, which project from the top surface of the cleaning unit 4, and are engaged in the engagement holes 1*c* and 1*d*, respectively, of the top frame 1 as shown in FIG. 4, are disengaged therefrom, allowing the top frame 1 to be taken off the cleaning unit 4. As a result, the top frame 1 among the four units is completely removed. The top frame 1 is recycled as is after it is cleaned of foreign matter such as the toner or dust clinging to the outer and inner surfaces thereof.

Figure 5:
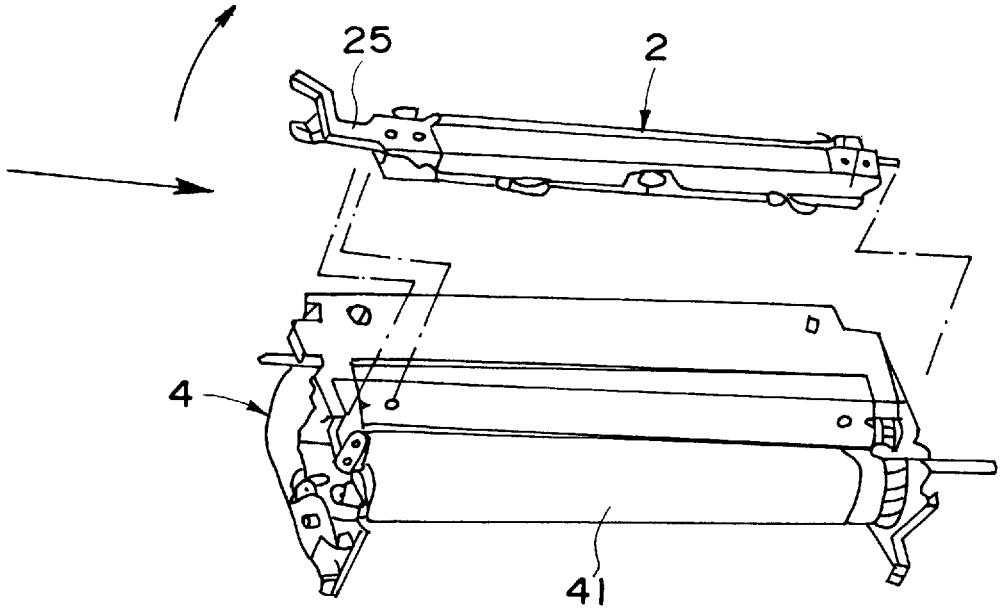
FIG. 5 is a perspective view of a cleaning unit, with the primary unit off.

Next, the primary charging unit 2 fitted in the top portion of the cleaning unit 4 is taken off. Referring to FIGS. 4 and 5, the primary charging unit 2 is provided with a leg portion 25, at one end, and is in engagement with the cleaning unit 4, being pressed toward the leg portion 25 by a pressing member (unillustrated) provided on the cleaning unit 4 on the side opposite to the leg portion. As the leg portion 25 is grabbed and pulled upward by a hand while being gently pushed sideways (arrow direction), the primary charging unit 2 is completely removed.

Figure 6:
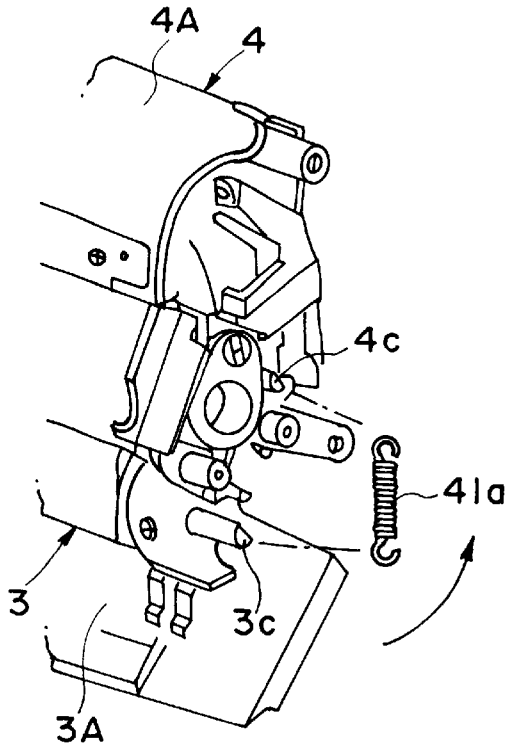
FIG. 6 is a perspective view of one of the longitudinal ends of the process cartridge, wherein a compression spring for pressing a developing roller toward the photosensitive drum has been removed.

Referring to FIG. 6, before disassembling the developing unit 3 and cleaning unit 4, a tension spring (spring member) 41*a*, which is stretched between, and anchored to, a projection 3*c* provided on the D frame 3A side and a projection 4*c* provided on the drum frame 4A side, is removed. Another tension spring 41*a*, which is substantially the same spring, and is stretched between the other ends of the developing unit 3 and cleaning unit 4, is removed in the same manner. These tension springs 41*a* or the like press the developing roller 33 of the developing unit 3 toward the photosensitive drum 41 of the cleaning unit 4, whereby the spacer (unillustrated) fitted around the periphery of the developing roller 33, at each longitudinal end, makes contact with the non-image forming region provided at each longitudinal end of the photosensitive drum 41, keeping a predetermined gap between the directly facing surfaces of the photosensitive drum 41 and developing roller 33. The tension spring 41*a* is reused during the reassembly as long as it meets a predetermined standard when tested by an inspector.

Figure 7:
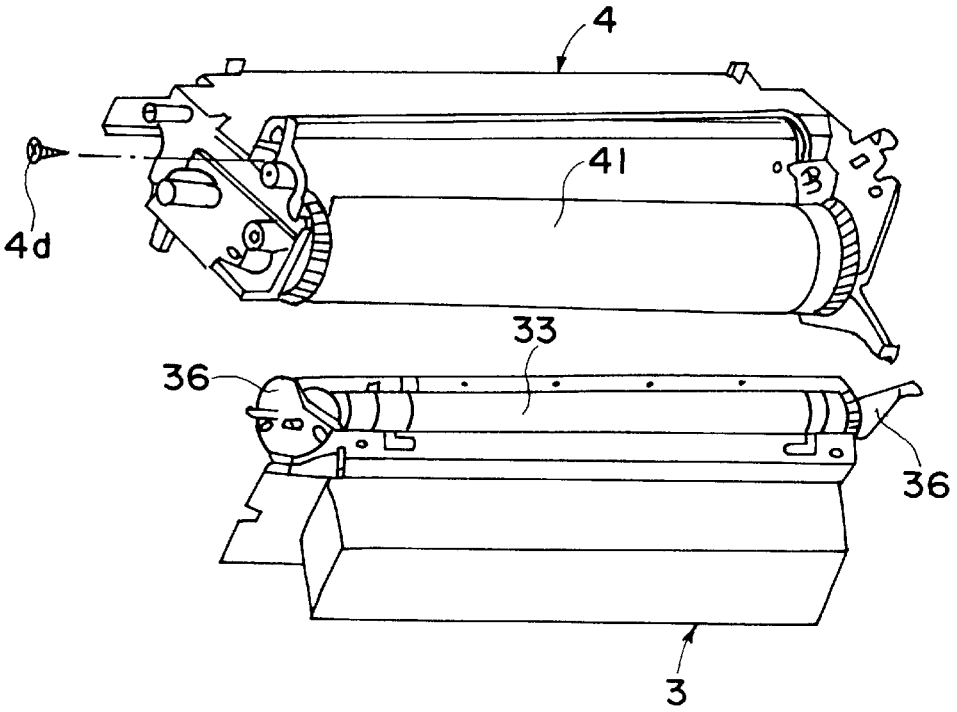
FIG. 7 is a perspective view of a developing unit and the cleaning unit, which have been separated from each other.

Even after the removal of the tension spring 41*a*, the developing unit 3 and cleaning unit 4 are pivotally in contact with each other at the left and right ends, respectively. In order to break this engagement, a pin 4*d* connecting the developing unit 3 and cleaning unit 4 is pulled out with the radio pliers. Then, after the developing unit 3 is rotated approximately 80° in the direction indicated by an arrow mark in FIG. 6, the developing unit 3 is slightly lifted by the right-hand end with reference to FIG. 7, whereby the engagement on the right-hand side is broken, allowing the developing unit 3 and cleaning unit 4 to separate from each other.

Thus, the process cartridge C is disassembled into four major units: the top frame 1, primary charging unit 2, developing unit 3, and cleaning unit 4.

Next, it will be described how each unit is further disassembled into smaller structural components, how they are cleaned, how they are exchanged, and how the like procedure is carried out.

To begin with, the top frame 1 does not comprise a portion which is rubbed by the other structural members. In other words, it does not have a portion to wear out; therefore, it is recycled as is when no anomaly is detected thereon after it is cleaned and inspected by the inspector.

(Remanufacture of Primary Charging Unit)

Figure 8A:
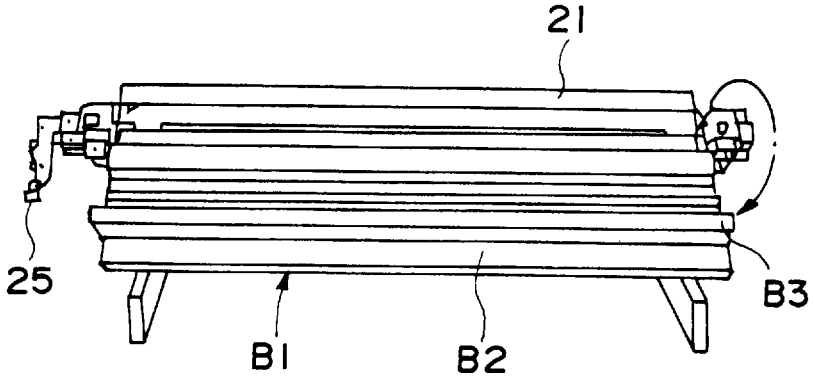
FIG. 8(*a*) is a perspective view of a jig and a shield mounted thereon, and FIG. 8(*b*) is a side view of the jig and the shield mounted thereon.
Figure 8B:
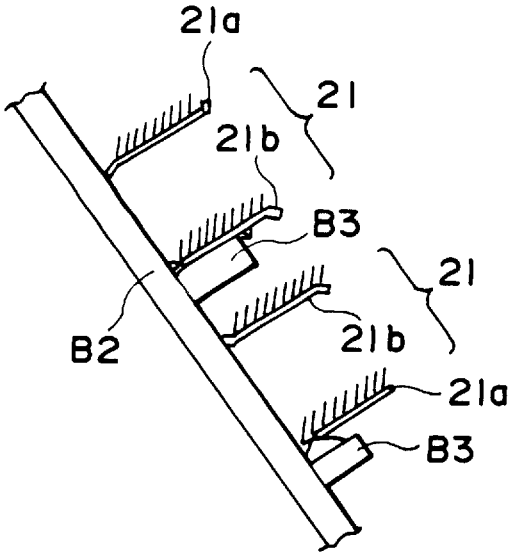
Figure 9:
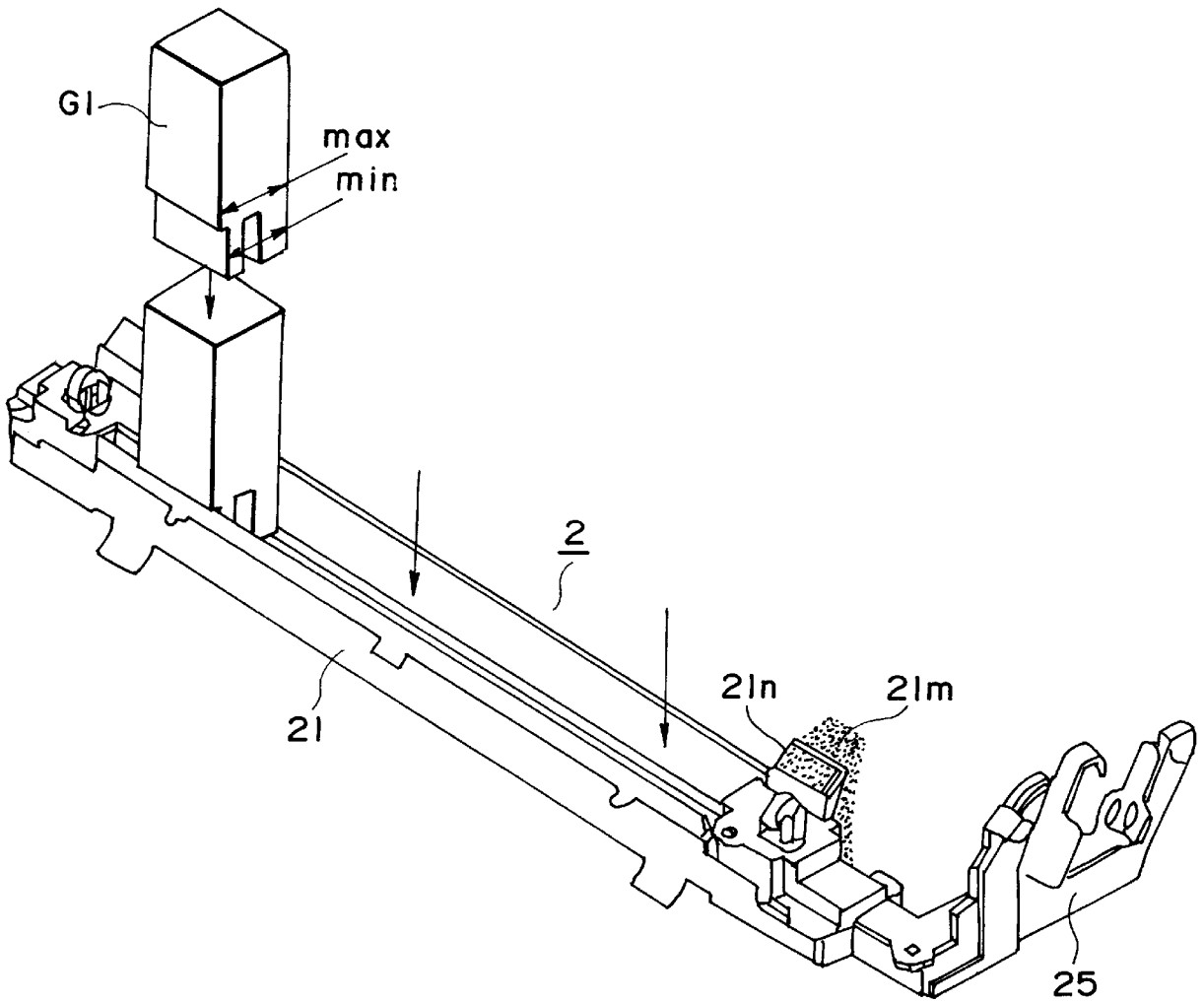
FIG. 9 is a perspective drawing to describe how the shield deformation is checked.
Figure 10A:
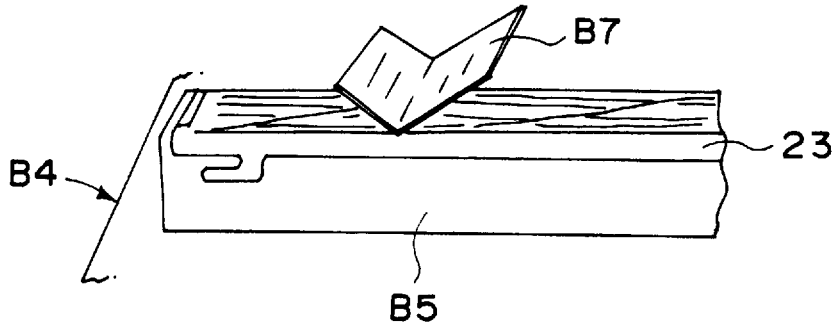
FIG. 10(*a*) is a perspective view describing how the grid surface is cleaned, and FIG. 10(*b*) is a perspective view describing how the grid is placed upside down.
Figure 10B:
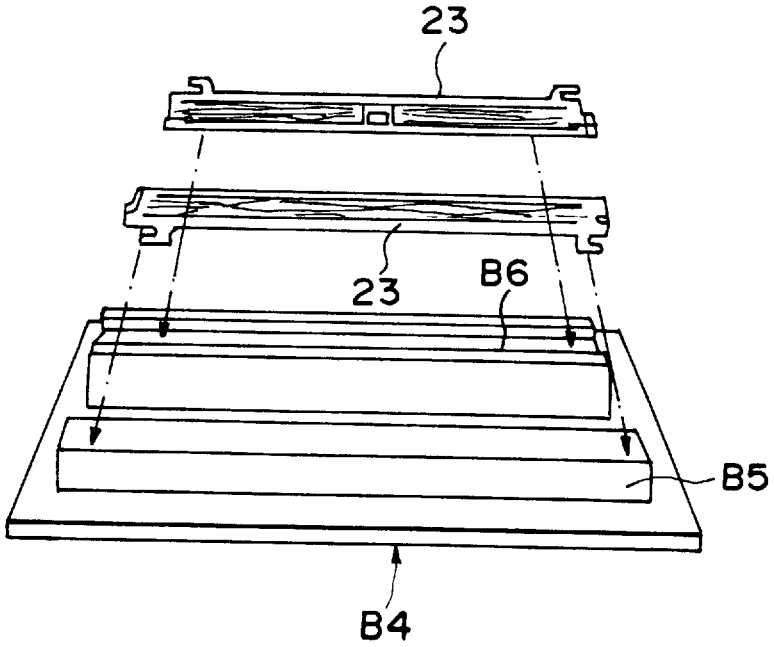
Figure 11:
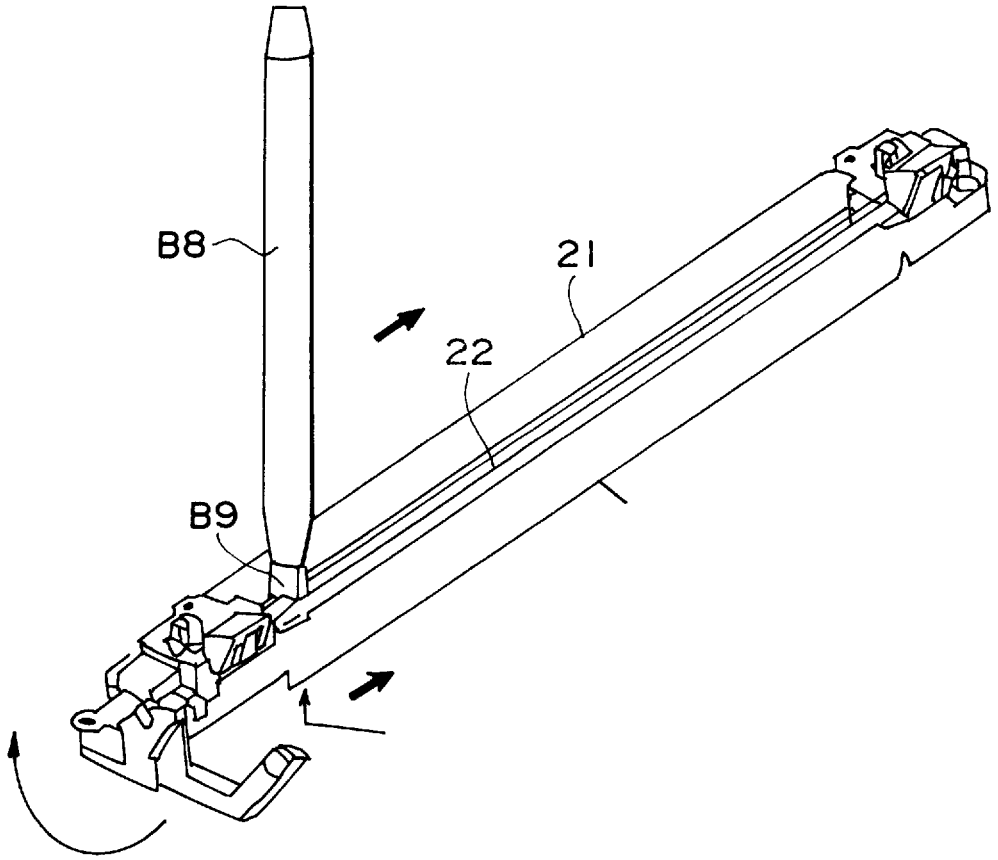
FIG. 11 is a perspective view showing how a discharge wire is cleaned.
Figure 12:
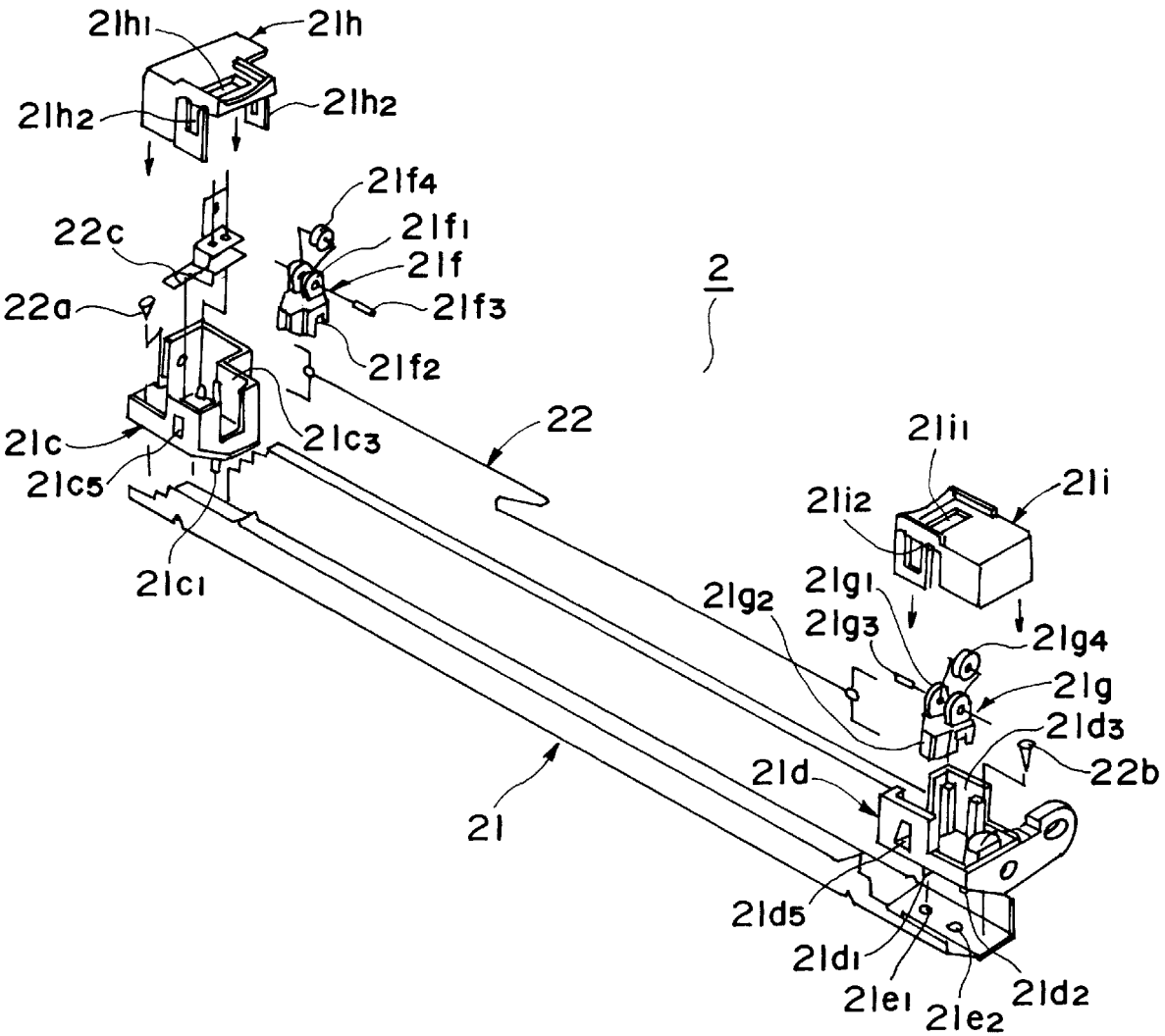
FIG. 12 is an exploded perspective view of the primary charging unit.
Figure 13:
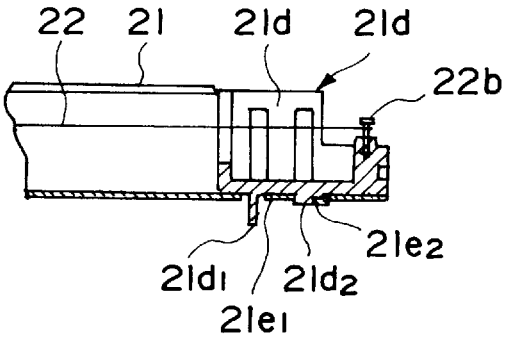
FIG. 13 is a longitudinal vertical section of the insulating block portion of the shield.
Figure 15:
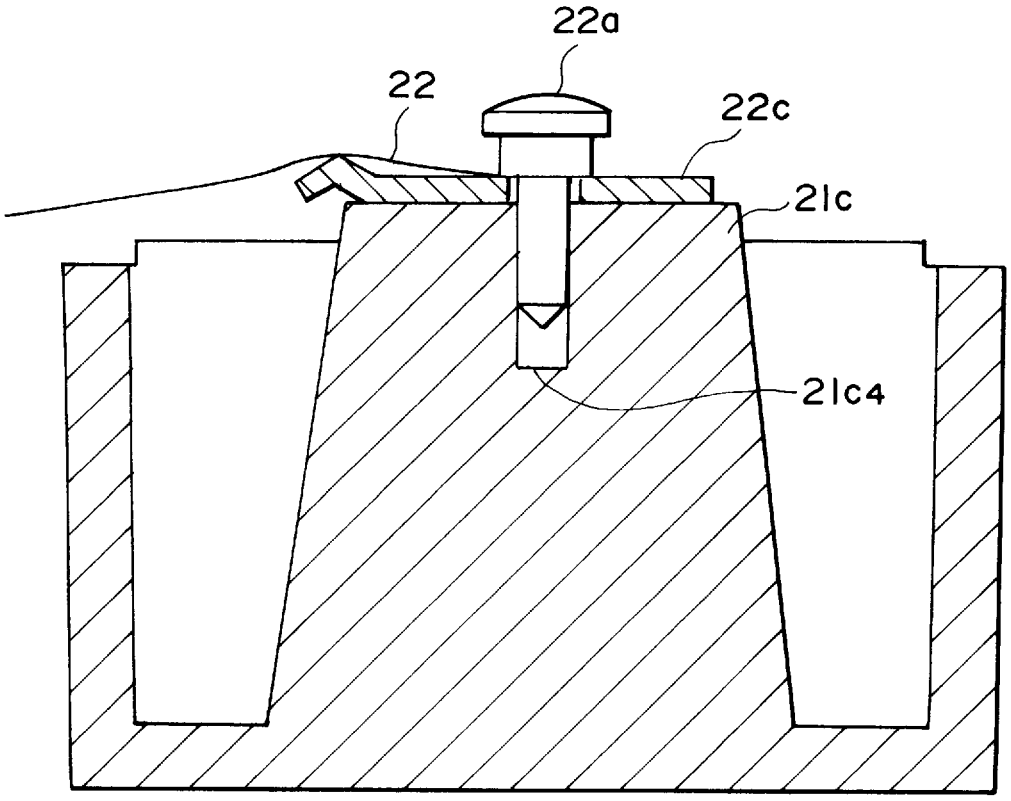
FIG. 15 is a vertical section of another insulating block portion, in the direction perpendicular to the longitudinal direction.

Next, the shield 21, discharge wire 22, and guide of the primary charging unit 2 are cleaned. First, the toner or dust adhering to the entire body of the primary charging unit 2 is removed. This is accomplished using a cleaning apparatus (unillustrated), for example. More specifically, the primary charging unit 2 is positioned at a predetermined spot within the cleaning chamber of the cleaning apparatus, and is entirely blown with air, while the air within the cleaning chamber is sucked out. Next, before starting to clean the individual members, a connecting spring (unillustrated) is removed to disengage the connected members, and then, the grid 23 is removed from the shield 21. Then, the shield 21 is placed on the slanted surface B2 of a jig B1 as shown in FIG. 8(*a*), and its position is fixed by a stopper B3 as shown in FIG. 8(*b*). Next, the shield 21 is cleaned with a sheet of Silbon paper soaked with IPA (isopropyl alcohol), on the outward facing surface of one of the wall portions 21*a* and the inward facing surface (hatched area) of the other wall portion 21*b*, and then, is flipped 180°, being thereby cleaned this time on the outward facing surface of the latter wall portion 21*b* and the inward facing surface (hatched area) of the first wall portion 21*a* in the same manner. This step must be very carefully performed so that no dust or fuzz of the Silbon paper adheres to the shield 21. After the cleaning, the shield 21 is checked for deformation. More specifically, referring to FIG. 9, a gauge G1 provided with a maximum portion and a minimum portion is inserted into one end of the shield 21 in order to confirm that the minimum portion freely slides, but the maximum portion is gently rejected. The gauge G1 is inserted into also the central portion and the other end of the shield 21 in order to confirm in the same manner the free passage of the minimum portion and the gentle rejection of the maximum portion. As for the grid portion 23, it is placed on the projection B5 of a jig B4 in such a manner that the grid portion 23 covers the projection B5 as shown in FIG. 10(*a*), and its exposed surface is cleaned with the SIRUBON paper B7. Thereafter, the grid 23 is reversely fixed on the jig B4 in such a manner that the grid 23 is fitted into a recess portion B6 as shown in FIG. 10(*b*), and then, is cleaned with the SIRUBON paper B7, this time on the inward facing surface. The discharge wire 22 is blown with the air, is dry-wiped with a piece of CR rubber, and then, is cleaned with a cleaner pen B8 as shown in FIG. 11. The tip B9 of the cleaner pen B8 is fitted with a piece of felt, which is cut to give a V-shaped notch and is impregnated with alcohol. In order to clean the discharge wire 22, the V-shaped tip of the cleaner pen B9 is gently placed across the discharge wire 22, and is moved from one end of the wire 22 to the other end in the direction of an arrow mark, with no downward pressure applied except for the weight of the pen itself. Next, the shield 21 is rotated 180°, and the same cleaning operation of the cleaner pen B8 is repeated to finish cleaning the discharge wire 22. The cleaned shield and discharge wire are examined by the inspector, and when it is confirmed by the inspector that their performances have been recovered, they are recycled. When the performance of the discharge wire 22, which is taken out of the primary charging unit 2 and cleaned, does not meet a predetermined standard, it is replaced in the following manner. First, the structure of the primary charging unit 2 will be briefly described. Referring to the exploded perspective view in FIG. 12, insulating blocks 21*c* and 21*d* are fixed at the left and right ends of the shield 21, respectively. On the downward facing surfaces of the insulating blocks 21*c* and 21*d*, pin-shaped projections 21*c*1 and 21*c*2 (unillustrated), and pin-shaped projections 21*d*1 and 21*d*2 are provided (refer to FIG. 13, in which only the portions belonging to the insulating block 21*d* are shown). These projections are put through small holes 21*e*1 and 21*e*2 drilled at the left and right ends of the shield 21, and one of the projections 21*d*2 is welded with heat and pressure, whereby the insulating blocks 21*c* and 21*d* are fixed to the left and right ends of the shield 21, respectively. The insulating blocks 21*c* and 21*d* are provided with engagement holes 21*c*4 (unillustrated) and 21*d*4 (refer to FIG. 4), and the discharge wire 22 is fixed at the left and right ends with pins 22*a* and 22*b*, which engage with the engagement holes 21*c*4 and 21*d*4, respectively. The pins 22*a* and 22*b* are members formed of resin material having less hardness than the insulating blocks 21*c* and 21*d*. Referring to FIG. 12, on the inward facing surface of the insulating blocks 21*c* and 21*d*, vertical guide portions 21*c*3 and 21*d*3 are provided, and elements 21*f* and 21*g* are vertically guided by these guide portions 21*c*3 and 21*d*4, respectively. These chassis 21*f* and 21*g* have arm portions 21*f*1 and 21*g*1 with V-shaped cutaway portions 21*f*2 and 21*g*2, respectively. On the arm portions 21*f*1 and 21*g*1, rollers 21*f*4 and 21*g*4 are rotatively supported with pins 21*f*3 and 21*g*3, which are put through the arm portions 21*f*1 and 21*g*1. As for the cutaway portions 21*f*2 and 21*g*2, they are placed across the discharge wire 22, at the left and right ends of the discharge wire 22, in such a manner as to press downward these portions as shown in the drawing. Therefore, the distance between the tips of the rollers 21*f*4 and 21*g*4, which are in contact with the photosensitive drum 41 surface, and the discharge wire 22, can be accurately maintained. In other words, the distance between the photosensitive drum 41 surface and discharge wire 22 is accurately regulated by the chassis 21*f* and 21*g*. Referring to FIGS. 12 and 15, on one, 21*c*, of the insulating blocks, an electrode 22*c* for applying a voltage to the discharge wire 22 is attached with the pin 22*a*.

Figure 14:
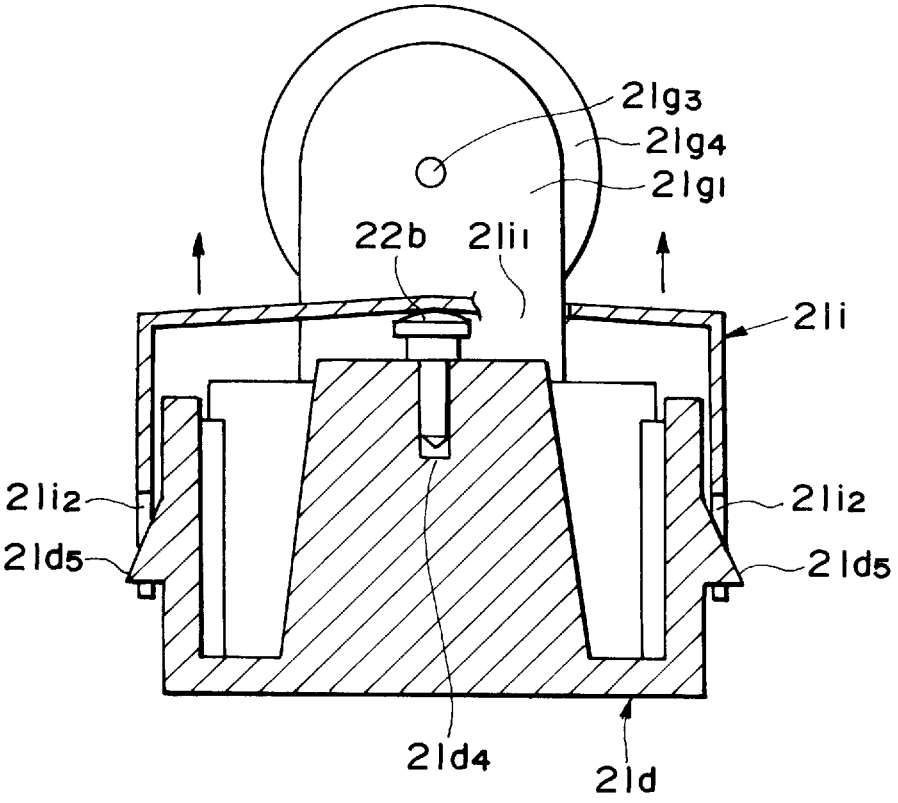
FIG. 14 is a vertical section of the same insulating block portion, in the direction perpendicular to the longitudinal direction.

Referring to FIG. 12, on the left and right insulating blocks 21*c* and 21*d*, covers 21*h* an 21*i* are attached in an easily removable manner. The covers 21*h* and 21*i* are provided with windows 21*h*1 and 21*i*1 and engagement holes 21*h*2, 21*h*2, 21*i*2 and 21*i*2. Referring to FIG. 14, the design of the cover 21*i* is such that when it is put, from above, on the insulating block 21*d*, the engagement holes 21*i*2 and 21*i*2 engage with the claws 21*d*5 and 21*d*5 of the insulating block 21*d*. When they are engaged, the arm portion 21*g*1 and roller 21*g*4 of the chassis 21*g* project through the window 21*i*1, and the pin 22*b* is pressed down into the engagement hole 21*d*4, whereby the discharge wire 22 is securely held. The structure of a cover 21*h* is the same as the cover 21*i*.

In order to replace the discharge wire 22, first, the left and right covers 21*h* and 21*i* are pulled by the bottom portions in a manner to open them, whereby the engagement holes 21*h*2, 21*h*2, 21*i*2 and 21*i*2 are disengaged from the corresponding claws 21*c*5, 21*c*5, 21*d*5 and 21*d*5. Then, the covers are lifted upward in the direction of the arrow marks, exposing thereby the left and right chassis 21*f* and 21*g*, and pins 22*a* and 22*b*, which fix the discharge wire 22 at the left and right ends, respectively. Since nothing is holding the left and right chassis 21*f* and 21*g* at this time, they can be removed upward following the guide portions 21*c*3 and 21*d*3. Next, the pins 22*a* and 22*b* are pulled out from the insulating blocks 21*c* and 21*d*, and the discharge wire 22, which have been wound around these pins 22*a* and 22*b*, is removed.

The discharge wire 22 and pins 22*a* and 22*b* are replaced with new ones. More specifically, the new discharge wire 22 is wound four times on the pins 22*a* and 22*b* at the left and right ends, respectively, and then, the pins 22*a* and 22*b* are fitted into the engagement holes 21*c*4 and 21*d*4 of the insulating blocks 21*c* and 21*d*. Next, the chassis 21*f* and 21*g* are placed at the left and right ends, in such a manner as to straddle across the discharge wire 22 stretched between the left and right pins 22*a* and 22*b*, and at the same time, to be fitted into the guide portions 21*c*3 and 21*d*3, respectively. Finally, the covers 21*h* and 21*i* are placed over the insulating blocks 21*c* and 21*d*, completing the process of exchanging the discharge wire 22.

The primary charging unit 2, of which performance has been recovered by the cleaning or replacement of the shield 21 and/or discharge wire 22, is remounted on the cleaning unit 4, which also has been through the disassembly, cleaning, inspection, and the like, which will be described later. At this time, the seal member 21*n* (in FIG. 9, only one of them is illustrated), which has been pasted adjacent to the left and right ends, is also recycled when no anomaly is discovered thereon. This seal member 21*n* is made of artificial leather, and it is disposed so as to rub on the photosensitive drum 41 surface. As a result, it usually suffers from severe wear, and often becomes unsuitable for reuse; therefore, it is replaced by a new one without being checked for its suitability for recycling. Further, adjacent to the seal member 21*n*, a seal member 21*m* formed of foamed urethane is disposed. Since this seal member 21*m* is simply placed in contact with a stationary member, it is seldom damaged; therefore, when no anomaly is discovered thereon through the inspection, it is recycled as is, instead of being replaced.

(Remanufacture of Developing Unit)

Figure 16:
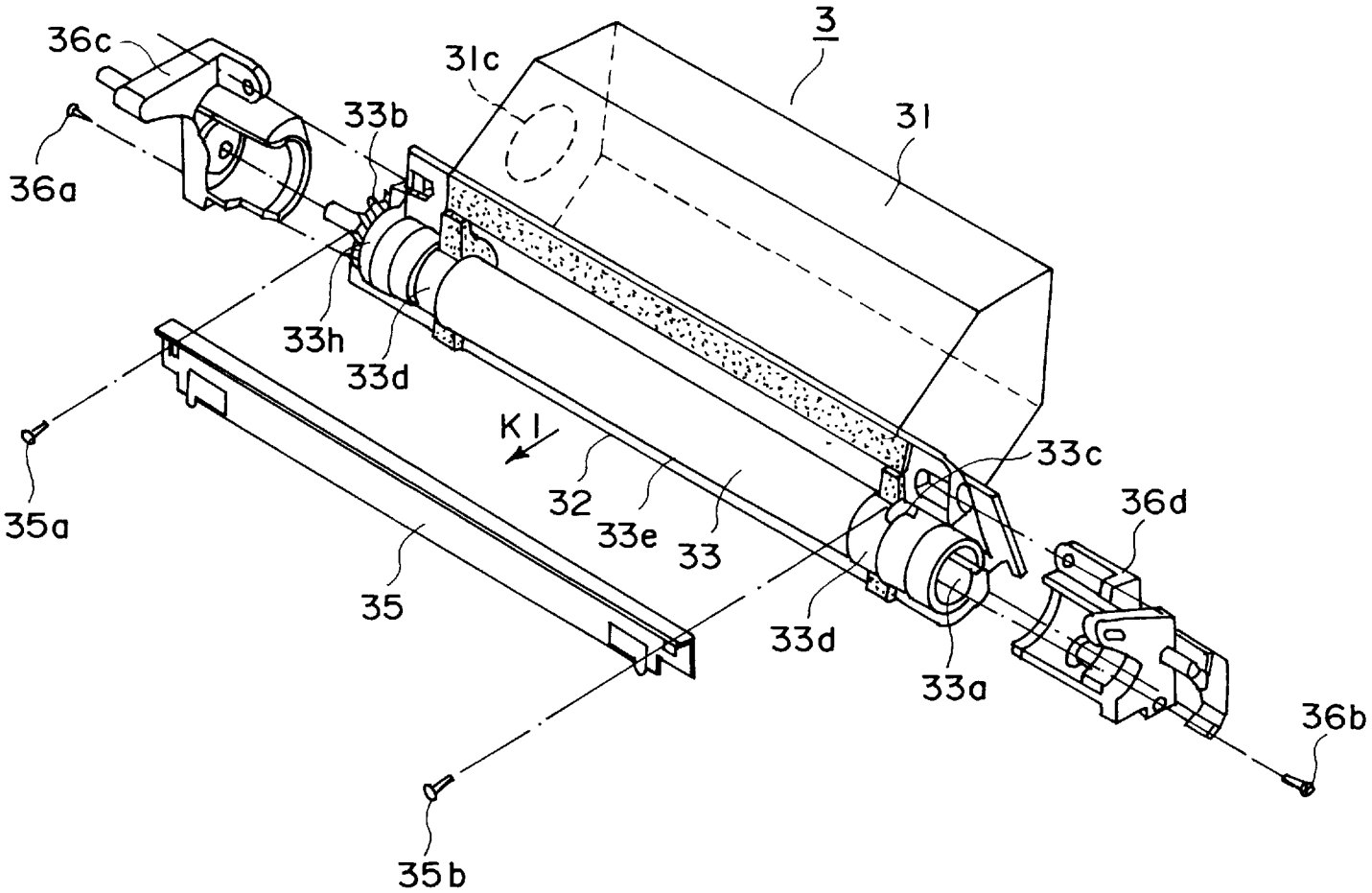
FIG. 16 is an exploded perspective view of the developing unit, with the developing blade and arm off.

Next, a remanufacturing method for the developing unit 3 will be described. First, the developing unit 3 separated from the cleaning unit 4 is disassembled into smaller portions in the following manner. Referring to FIG. 16, a developing blade 35 is removed by removing screws 35*a* and 35*b*, and the left and right arms 36*c* and 36*d* are pulled out by removing the left and right end screws 36*a* and 36*b*; the developing roller 33 having been fixed to the D frame 32 by the left and right arms 36*c* and 36*d*, and a magnet 33*a* having been placed in the developing roller 33, are removed in the frontward direction (direction of an arrow mark K1). The developing roller 33 is further disassembled into smaller parts: a magnet 33*a*, a roller gear 33*b*, a bearing (front) 33*c*, a developing roller base member 33*e*, a couple of rollers 33*d* and 33*d*, a bearing (rear) 33*h*, and a roller electrode (unillustrated), which are separated into recyclable and non-recyclable groups. Those recyclable are cleaned with the high pressure air or the like. When found with no anomaly through inspection, the developing blade 35, roller gear 33*b*, and the like are reused, whereas those revealed by the inspection that their performance does not meet a predetermined standard are replaced by new ones as needed.

In this embodiment, the members such as developing roller 33, developing blade 35, or the like are recycled when it is revealed by the inspection that their performance satisfies a predetermined standard, but the T frame 31 and D frame 32 are always replaced with new ones. This is because the T frame 31 and D frame 32 of the developing unit 3 are welded together, making it impossible to separate them, which in turn makes it impossible to reseal perfectly the opening 31*a* of the T frame 31 during the remanufacture. Therefore, a new T frame 31 and a new D frame 32 are separately prepared, and before two frames are joined, the opening 31*a* of the T frame 31 is airtightly sealed with the sealing film (toner seal) by heat sealing, and then, the two are welded together. The T frame 31, D frame 32, drum frame, and the like are formed of highly impact resistant styrene, polyphenylene oxide, or the like.

Figure 17:
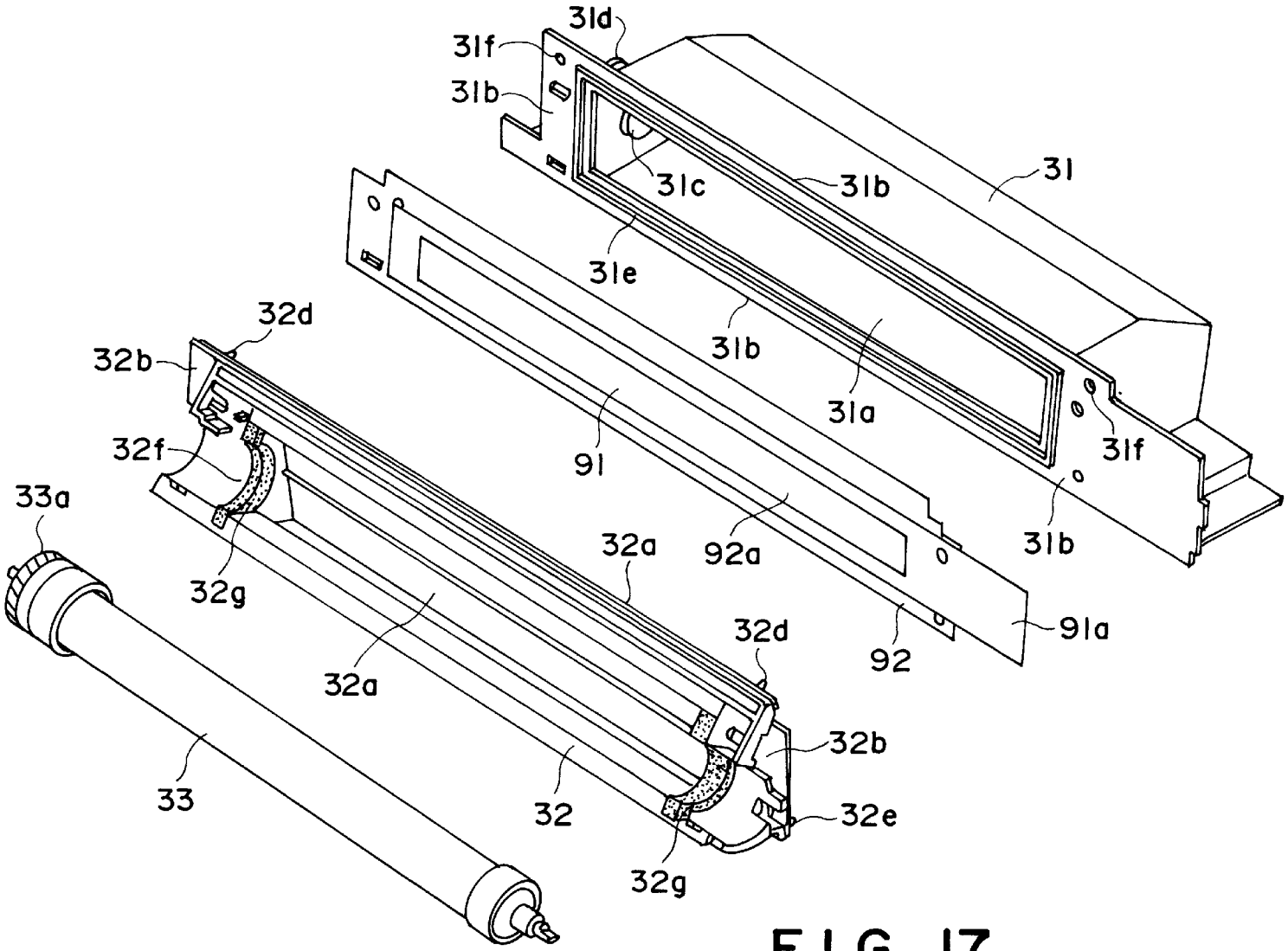
FIG. 17 is an exploded view of the developing unit.
Figure 20A:
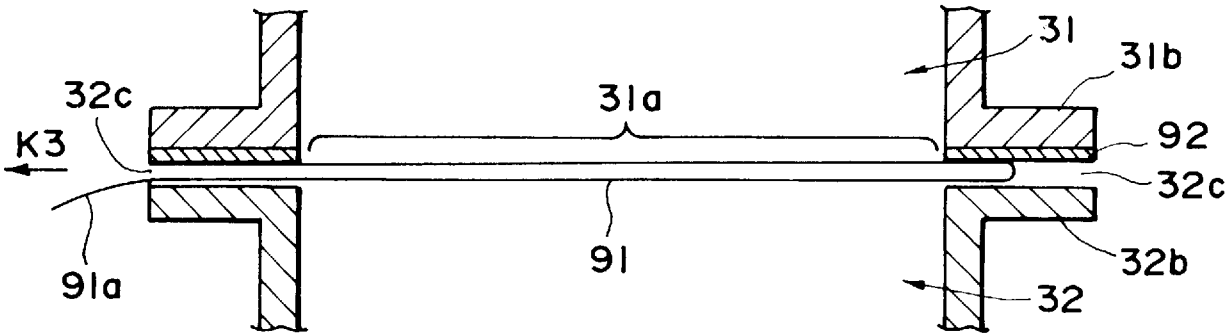
FIGS. 20(*a*) and 20(*b*) are explanatory drawings describing how the sealing film is peeled to expose an opening.
Figure 20B:
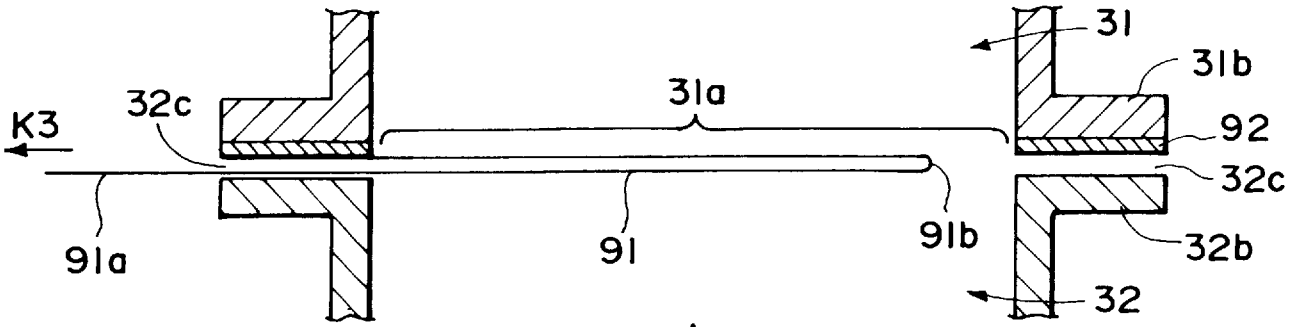

More specifically, referring to FIG. 17, before the sealing film 91 is placed over the opening 31*a*, the T frame 31 and D frame are separate members, and they are united after the sealing film 91 is attached; therefore, it is easy to seal perfectly the opening 31*a* with the sealing film 91. Also referring to FIG. 17, the T frame 31 comprises a picture frame-like flange portion 31*b* extending outward from the entire perimeter of the rectangular opening 31*a*, and also, the D frame comprises a flange portion 32*b* having substantially the same shape. The sealing film 91 is mounted on a plastic base member, which is a plate member having the same picture frame-like configuration as the flange portions 31*b* and 32*b*. In other words, the sealing film 91 and base member 92 are separably united by means of heat sealing or the like. The reason why the sealing film 91 is separably mounted on the base member 92 is to allow the operator to peel off the sealing film 91 before the process cartridge is put to use, so that the toner within the T frame 31 is supplied to the developing roller 33. Next, the T frame 31 and D frame 32 are joined in such a manner that the base member 92 is pinched between the flange portion 31*b* of the T frame 31 and the flange portion 32*b* of the D frame 32. It should be noted here that a slit 32*c* (refer to FIG. 20) is provided on the D frame 32, on the surface portion facing the sealing film 91, so that the sealing film 91 is not hindered from being separated. In order to uncover the opening 31*a*, a tip 91*a* of the sealing film 91 projecting from one of the slits 32*c* is pulled in the direction of an arrow mark K3, moving thereby the doubling back point 91*b* of the sealing film 91 as shown in FIG. 20(*b*) till the sealing film 91 is completely pulled out to uncover fully the opening 31*a*.

Next, the sealing process using the sealing member 91 will be described. To begin with, the sealing film 91 is attached to the base member 92 with an opening 92*a*, by heat sealing. As for the base member 92, an approximately 0.3 mm to 2.0 mm thick plate of plastic material such as polyester, polystyrene, nylon, ABS, or the like is formed into sheet, and then, the opening 92*a* is punched out, or the picture frame-shaped base member 92 is molded in an ordinary method.

Figure 18:
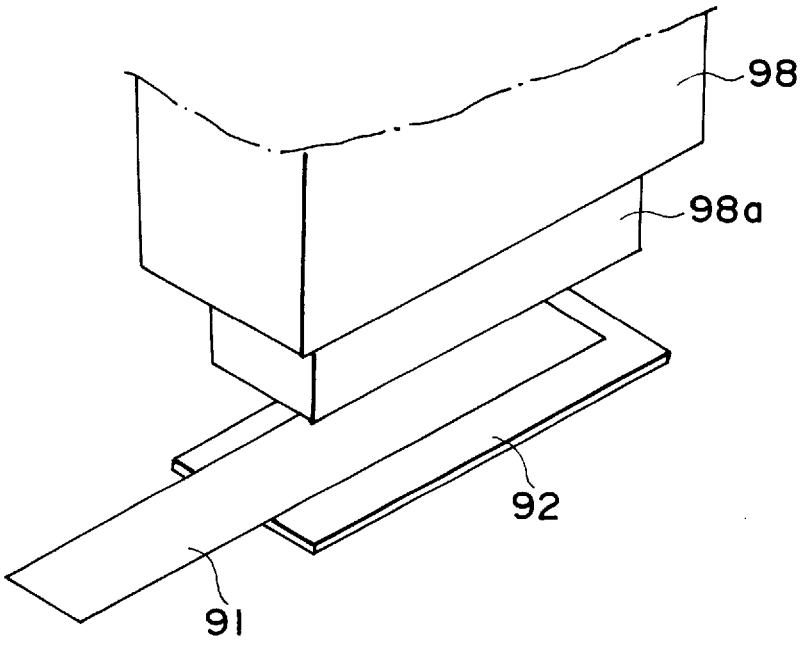
FIG. 18 is an explanatory drawing describing how a sheet of sealing film is attached to the base member by heat-sealing.

Next, the sealing film 91 is heat-sealed to the thus made base member 92, by applying heat and pressure as shown in FIG. 18. As for an example of the sealing conditions, the temperature of the sealing bar 98*a* of the horn 98 is approximately 110° C. to 130° C.; the pressure, approximately 1.5 kgf/cm2 to 5 kgf/cm2; and the time is approximately 1 second to 3 seconds.

During the heat-pressure sealing by this sealing bar 98*a*, a certain caution must be taken so that the base member 92 and the sealing bar 98*a* make uniform and parallel contact. When the contact is non-uniform, the sealing film 92 is subjected to excessive stress, which is liable to cause the sealing film 91 to break from inside the sealed surface when the process cartridge is subjected to an impact or is dropped.

Next, the base member 92, to which the sealing film 92 has been heat-sealed, is welded to the flange portion 31*b* of the T frame 31. For this reason, a rib 31*e* is provided on the flange portion 31*b*, on the surface that makes contact with the base member 92, in such a manner as to surround the opening 31*a*. This rib 31*e* melts and welds itself to the base member 92 during the ultrasonic welding.

As the rib 31*e* melts, the opening 31*a* of the T frame 31 is completely sealed by the base member 92, to which the sealing film 91 has been attached.

Figure 19:
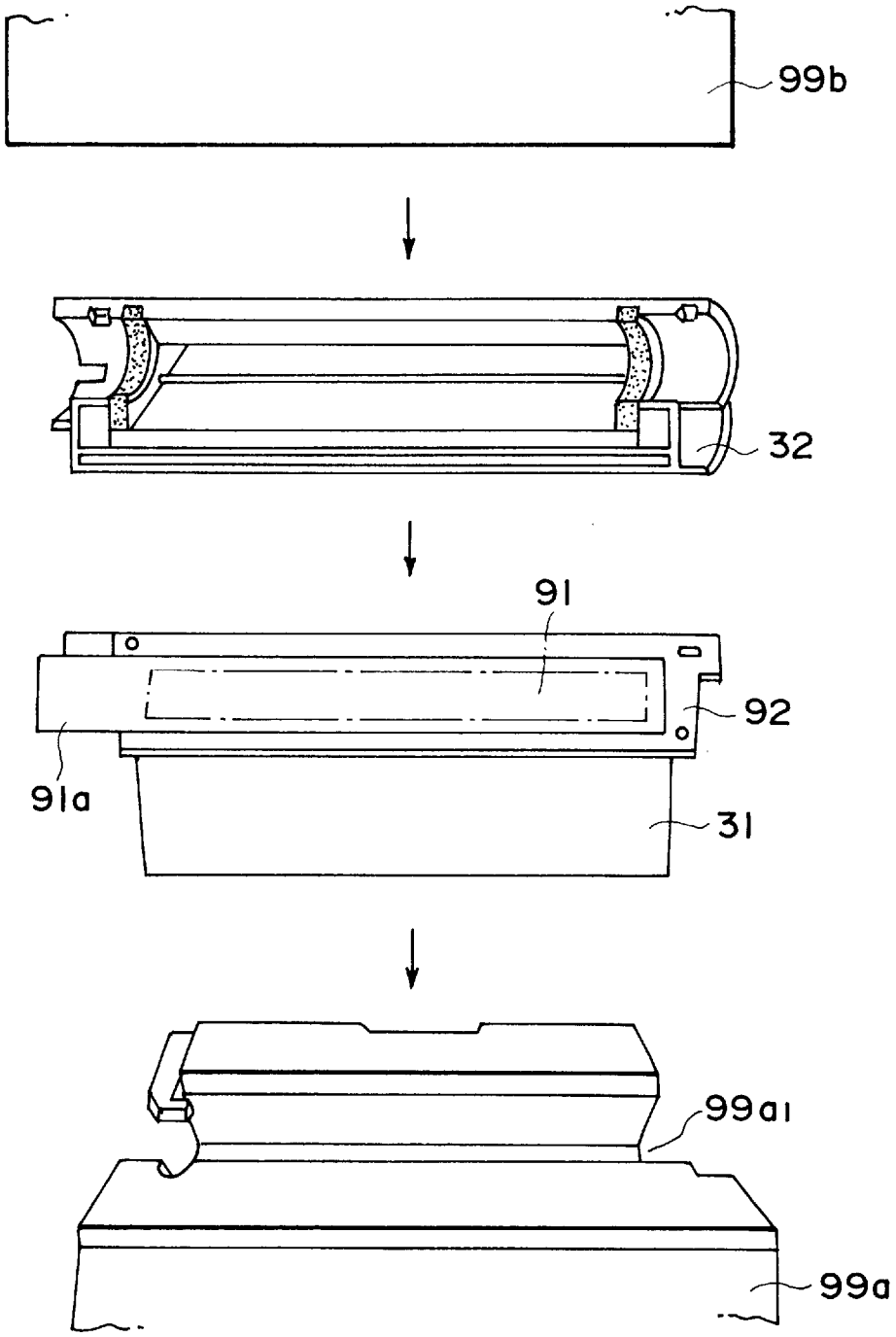
FIG. 19 is an explanatory drawing describing how the toner chamber frame and developing chamber frame are united by melt-welding.

Next, the T frame and D frame are welded together using ultrasonic waves. This is accomplished by using a jig as shown in FIG. 19. More specifically, the T frame 31 is set in the recess 99*a*1 of a holding jig 99*a*, and the sealing film 91 having been heat-sealed to the base member 92 is folded back. This sealing film 91 is given more than twice the length of the opening 92*a* of the base member 92 so that when folded back, the tip 91*a* thereof sticks out from one longitudinal end of the T frame 31.

Next, the D frame 32 is placed on top of the T frame 31, and the D frame 32 is pressed from above with a pressing jig 99*b*. At this time, the free end of the sealing film 91 is placed so as to stick out of the slit 32*c* (FIG. 20(*a*)). In this state, the ultrasonic waves are applied to the T frame 31 and D frame 32, whereby the rib 32*e* (FIG. 17) extended on the welding surface of the D frame 32 in the longitudinal direction of the D frame 32 melts and welds itself to the welding surface of the D frame 31, uniting thereby two frames 31 and 32.

Referring to FIG. 17, the D frame 32 comprises a positioning boss 32*d* disposed at a predetermined location on the joining surface, and correspondingly, the D frame comprises a positioning hole 31*f* disposed so as to accommodate the boss 32*d*. Thus, when the frames 31 and 32 are placed on top of each other, the boss 32*d* is fitted into the hole 31*f* to fix the positional relationship between two frames, which can prevent the frames 31 and 32 from being displaced from each other, or from becoming deformed.

Figure 21:
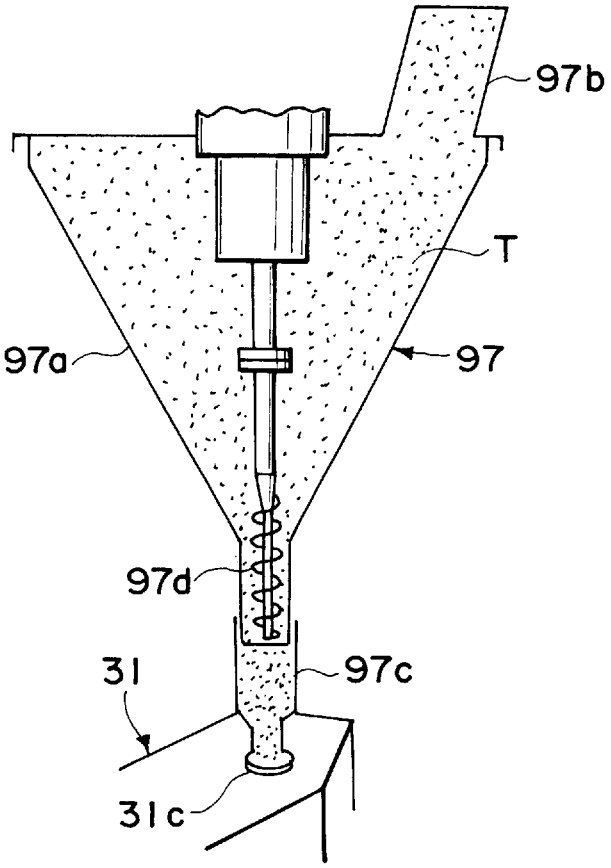
FIG. 21 is an explanatory drawing depicting the operation for replenishing the developing unit with the toner.

Next, the toner is filled into the T-D frame formed through the integration of the T frame and D frame by the aforementioned welding. More specifically, referring to FIG. 21, the toner T is refilled through a toner supply opening 31*c* using a developer hopper 97 or the like. At the top end of the funnel-shaped main body 97*a*, a supply opening 97*b* is provided for supplying the toner T, and at the bottom end, an adaptor 97*c* that fits into a toner supply opening 31*c* of the T frame 31 is provided. Further, within the main body 97*a*, a rotatable auger 97*d* is disposed. The toner refilling speed is adjusted by controlling the revolution of this auger 97*d* as needed. The internal surface or the like of the main body 97*a* may be treated with fluororesin or the like to reduce the coefficient of friction. Such a treatment enables the toner to be refilled from the developer hopper 97 into the T-frame with higher efficiency.

After the toner is refilled, a cap 31*d* is put on the toner supply opening 31*c* of the T frame 31 (refer to FIG. 17). Then, the developing blade 35, developing roller 33, and the like, which have been cleaned with the high pressure air or the like, are mounted on the T frame in the reverse order to the disassembling order, reconstructing thereby the developing unit 3. It should be noted here that normally, a new cap 31*d* is used during this reconstruction. This is to prevent the cap 31*d* from coming off unexpectedly.

When the T frame 31 and D frame 32 are welded together, the force holding together the frames 31 and 32 becomes very strong, preventing thereby the occurrence of the toner leak. As for the welding method, ultrasonic welding, vibration welding, or the like can be used. The ultrasonic welding takes a relatively short time to provide a stronger holding force.

Further, the use of the base member 92 allows the sealing film 91 to be mounted between two frames 31 and 32, with a proper strength (suitable for an operator to pull out). Further, the amount of the toner to be supplied from the T frame 31 to the D frame 32 can be adjusted by varying the size of the opening 92*a* of the base member 92.

(Remanufacture of Cleaning Unit)

Next, the remanufacture of the cleaning unit 4 will be described. The cleaning unit 4 is recycled after the drum frame 4A is cleaned. First, a cleaning apparatus for disassembling and cleaning the cleaning unit 4 will be described. To begin with, the protective plate 43 (FIG. 1) and photosensitive drum 41 are removed from the cleaning unit 4, and in this state, the waste toner is extracted (cleaning operation), which will be described later. In the descriptions given above, a terminology "cleaning unit 4" meant a cleaning unit 4 comprising the photosensitive drum 41 and protective plate 43, but in the description to be given hereinafter, it will be designated as the cleaning unit 4 as needed even when it does not includes these components.

Figure 22:
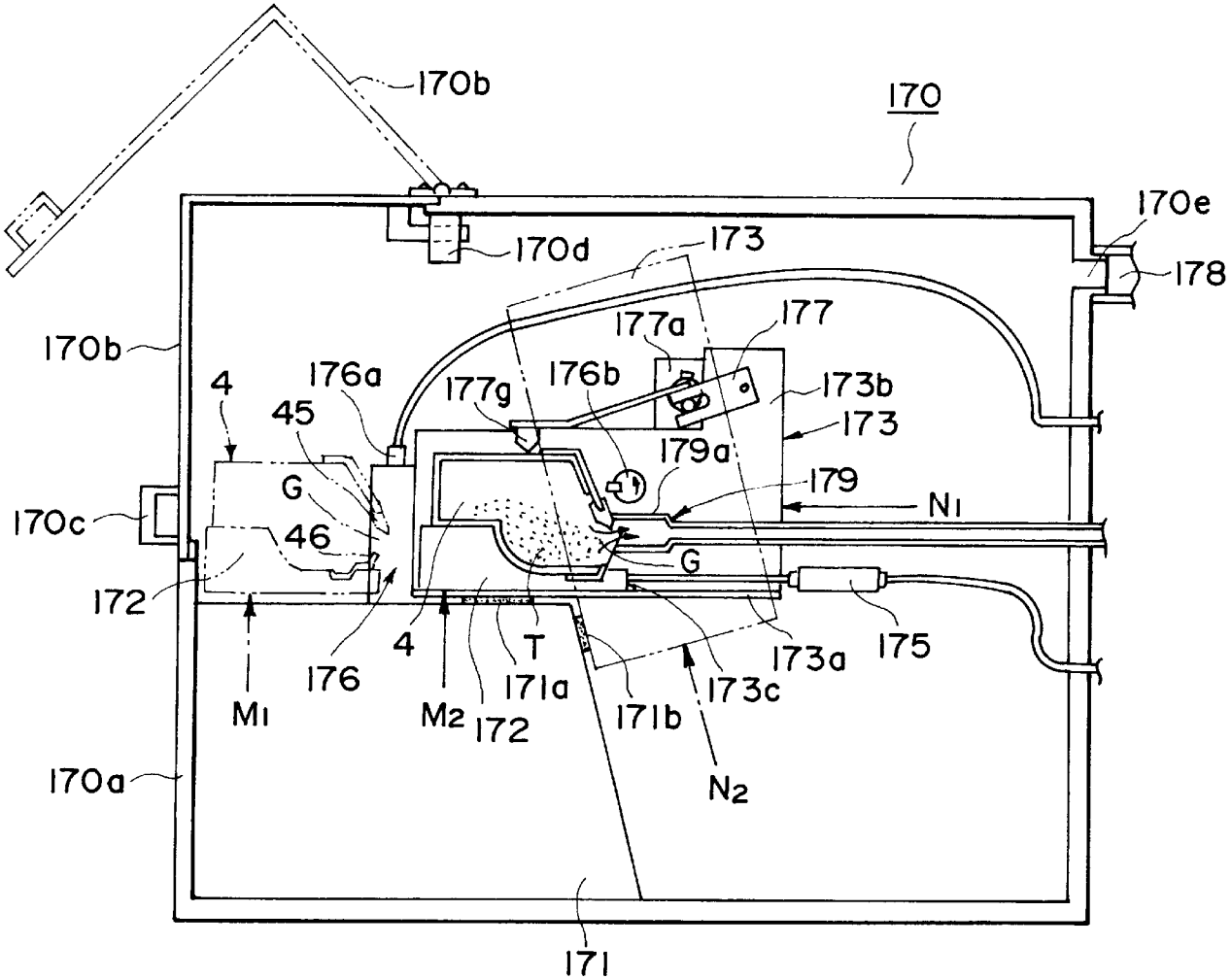
FIG. 22 is a vertical sectional view of the general structure of the cleaning apparatus of the cleaning unit.

Referring to FIG. 22, the structure of the cleaning apparatus will be described. A cleaning apparatus 170 comprises a housing 170*a*, which covers the entire structure of the apparatus. At the top front portion of the housing 170*a*, a transparent cover 170*b* with a knob 170*c* is mounted. It can be opened or closed as needed, and its state, that is, whether it is open or closed, is detected by a detection sensor 170*d*. On the top rear portion (top right portion in the drawing) of the housing 170*a*, an exhaust vent 170*e* is provided, and it is connected to the sucking end opening of an auxiliary sucking apparatus.

Within the housing 170*a*, a stopper table 171 is disposed at the bottom front so as for its flat top surface to be level. The surface of its rear lateral wall is slanted with a steep angle. On these level and slanted surfaces, a stopper 171*a* and 171*b* made of rubber material are fixed to regulate the oscillating range of an oscillating apparatus, which will be described later.

Figure 23:
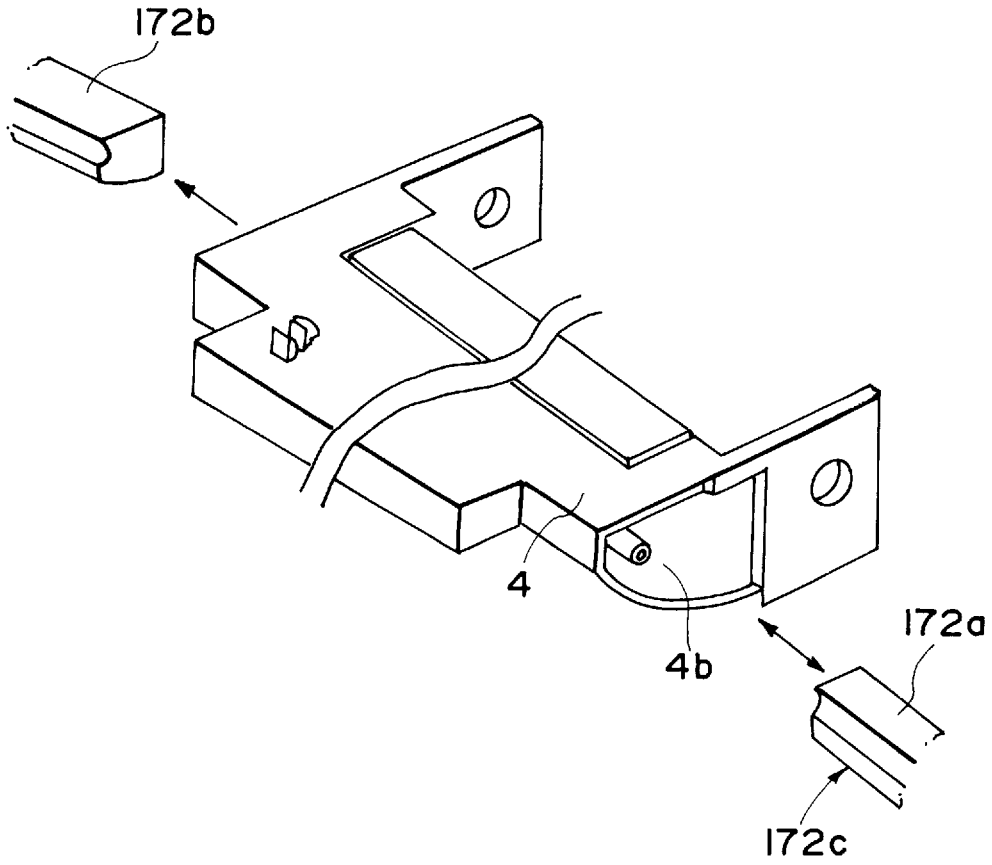
FIG. 23 is a perspective view for describing how the process cartridge is clamped.

On the level surface of the stopper table 171, a receptacle table 172, which is movable in the backward and forward direction, is disposed. The receptacle table 172 is moved between a home position M1 (double dot chain line in FIG. 22) and a cleaning position M2 (solid line in the same drawing) by an air cylinder 175 connected to the backside thereof. The top surface of the receptacle table 172 is given a shape that matches the bottom surface of the cleaning unit 4. As indicated by the double dot chain line in FIG. 22, the cleaning unit 4 is placed on the top surface of the receptacle table 172 located at the home position M1, being oriented in such a manner that its cleaning blade 45 and scooping sheet 46 are disposed at the top and bottom rear portions, respectively. Therefore, a gap G formed between the tips of the cleaning blade 45 and scooping sheet 46 is located at the rear. The receptacle table 172 is provided with a clamping apparatus 172*c* comprising a movable block 172*a* and a fixed block 172*b* as shown in FIG. 23. It should be noted here that the perspective view in FIG. 23 depicts the cleaning unit 4 on the receptacle table (unillustrated) located at the home position M1, being oriented as described above. The structure of the clamping apparatus 172*c* is such that when the cover 170*b* (double dot chain line in FIG. 22), which has been opened before the cleaning unit 4 is mounted on the receptacle table 172 located at the home position M1, is closed (solid line in the same drawing) after the cleaning unit 4 is mounted, this closing action detected by the aforementioned detection sensor 170*d* triggers the clamping apparatus 172*c* to grip the cleaning unit 4 on the receptacle table, and thereby, fixes the position of the cleaning unit 4. In other words, the initiation of the clamping operation of the clamping apparatus 172 is linked to the closing of the cover 170*b*. More specifically, after the cover 170*b* is closed, a positioning block 172*a* illustrated in FIG. 23 is extended, by the unillustrated air cylinder, to be placed in contact with an engagement portion 4*b* provided on the lateral surface of the cleaning unit 4, and then, it is further extended, sliding the cleaning unit 4 till the opposite lateral surface of the cleaning unit 4 comes in contact with a fixing block 172*b*.

Figure 24A:
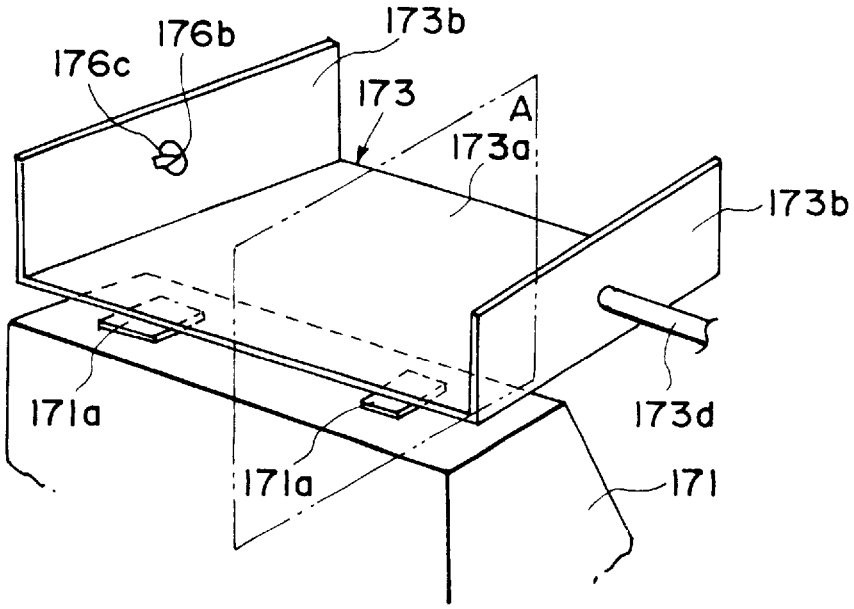
FIG. 24(*a*) is a perspective view of an oscillating apparatus.
Figure 24B:
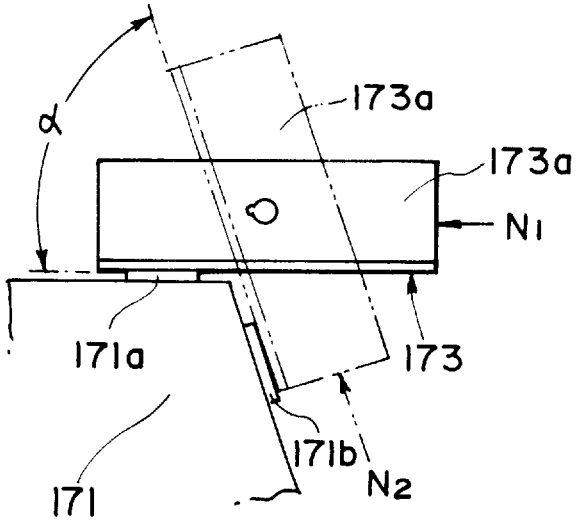

When the receptacle table 172 is at the cleaning position M2, at which its bottom rear portion is regulated by the stopper 173*c* (refer to FIG. 22), it is mounted on an oscillating apparatus (moving apparatus) 173. The oscillating apparatus 173 comprises an oscillating table 173*a* provided with left and right side plates 173*b* and 173*b* erected from the left and right edges of the bottom plate as shown in FIG. 24(*a*). This oscillating table 173*a* is pivotally supported with a rotational axis 173*d* fixed to the outward facing surface of one of the side plates 173*b*. On the other side plate 173*b*, an oscillating axis 176*b* is supported at a position corresponding to the rotational axis 173*d*, with the interposition of a key 176*c*. The oscillating axis 176*b* is caused to alternate backward and forward rotations within a predetermined angle $\alpha$ by a combination of a rotary actuator 176 and an air cylinder 176*a*. Referring to FIGS. 24(*b*) (section of Figure (*a*) at a plane A), as this oscillating axis 176*a* alternates the backward and forward rotations, the oscillating table 173*a* is oscillated by the angle of $\alpha$ between a level position N1 (solid line in the same drawing) and an upright position N2 (double dot chain line in the same drawing). The level position N1 and upright position N2 of the oscillating table 173*a* are fixed by the stopper 171*a* and 171*b* of the aforementioned stopper table 171. In this embodiment, the oscillating angle $\alpha$ is set at 80°.

Figure 25A:
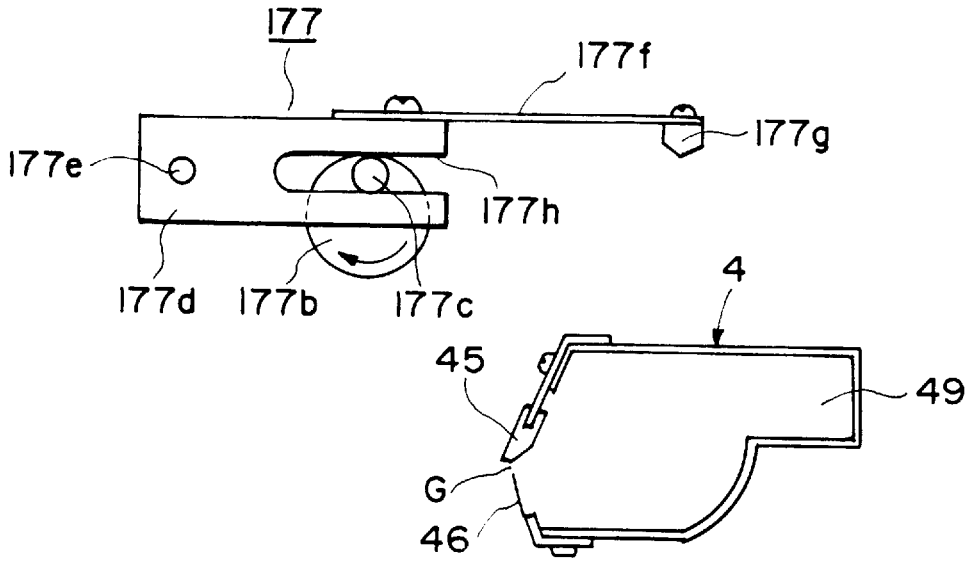
FIG. 25(*a*) and 25(*b*) are explanatory drawings depicting the operation of a tapping apparatus, and FIG. 25(*c*) is a perspective view of the structures of a motor shaft and a cam shaft.
Figure 25B:
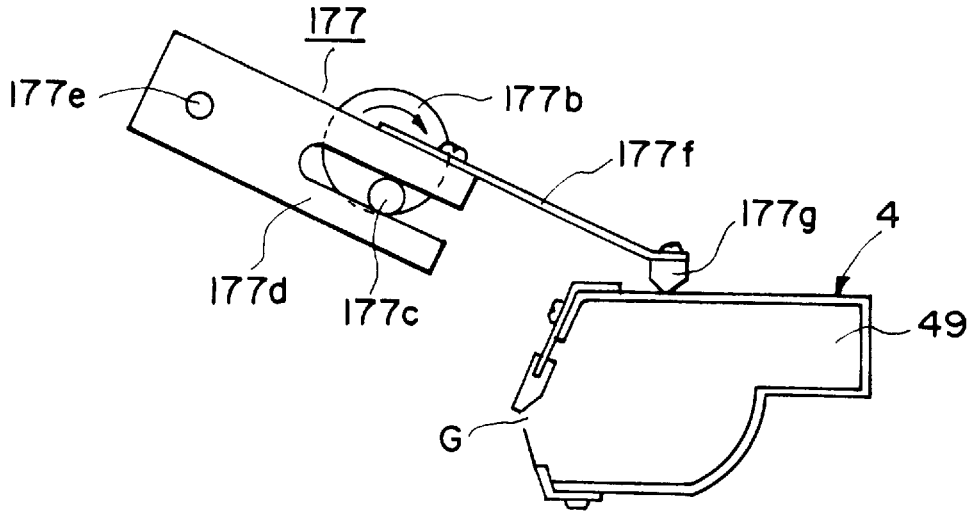
Figure 25C:
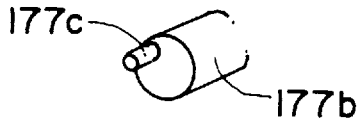

At the top rear portion of the oscillating table 173*a* at the level position N1 (solid line in FIG. 22), a tapping apparatus 177 is disposed, which taps the cleaning unit 4 as it is driven by a motor 177*a*. Referring to FIG. 25(*a*) (depicting the tapping apparatus 177 as seen from the opposite side of FIG. 22), the tapping apparatus 177 comprises: a cam shaft 177*c* (FIG. 25(*c*)) projecting eccentrically from one end of a motor shaft 177*b*; a tapping table 177*d*, which has an oscillating center 177*e* on the base side, and a guide groove 177*h* that engages with the aforementioned cam shaft 177*c* in a sliding manner, on the free end side; a tapping plate 177*f* screwed on the top surface of the free end of the tapping table 177*d*; and a projecting member 177*g* fixed at the free end of the tapping plate 177*f* so as to face downward. The tapping plate 177*f* is a plate of elastic material having a proper amount of elasticity. The projecting member 177*g* is made of resin material having a hardness slightly less than that of the waste toner storage 49 of the cleaning unit 4, which is where the cleaning unit 4 is tapped, so that the cleaning unit 4 is not damaged. In the tapping apparatus 177, the tapping table 177*d* is oscillated in the substantially vertical direction by the rotation of the cam shaft 177*c*, which is integral with the motor shaft 177*b*, in the direction of an arrow mark. With this oscillation, the projecting member 177*g* is alternately moved away from the cleaning unit 4 (FIG. 25(*a*)) and caused to strike the top surface of the cleaning unit 4 (FIG. 25(*b*)). In these drawings, only one set of the tapping table 177, tapping plate 177*f*, and projecting member 177*g* is illustrated, but a pair of such sets may be provided. In such a case, two pair of such sets are to be connected with a shaft, for example, and the cleaning unit 4 is to be tapped on the top surface, at points P and P indicated in FIG. 26.

Referring to FIG. 22, at the aforementioned cleaning position M2, the receptacle table 172, air cylinder 175, and tapping apparatus 177 are all mounted on the oscillating table 173*a* of the oscillating apparatus 173. In other words, these components are moved together with the oscillating table 173*a*.

Figure 26:
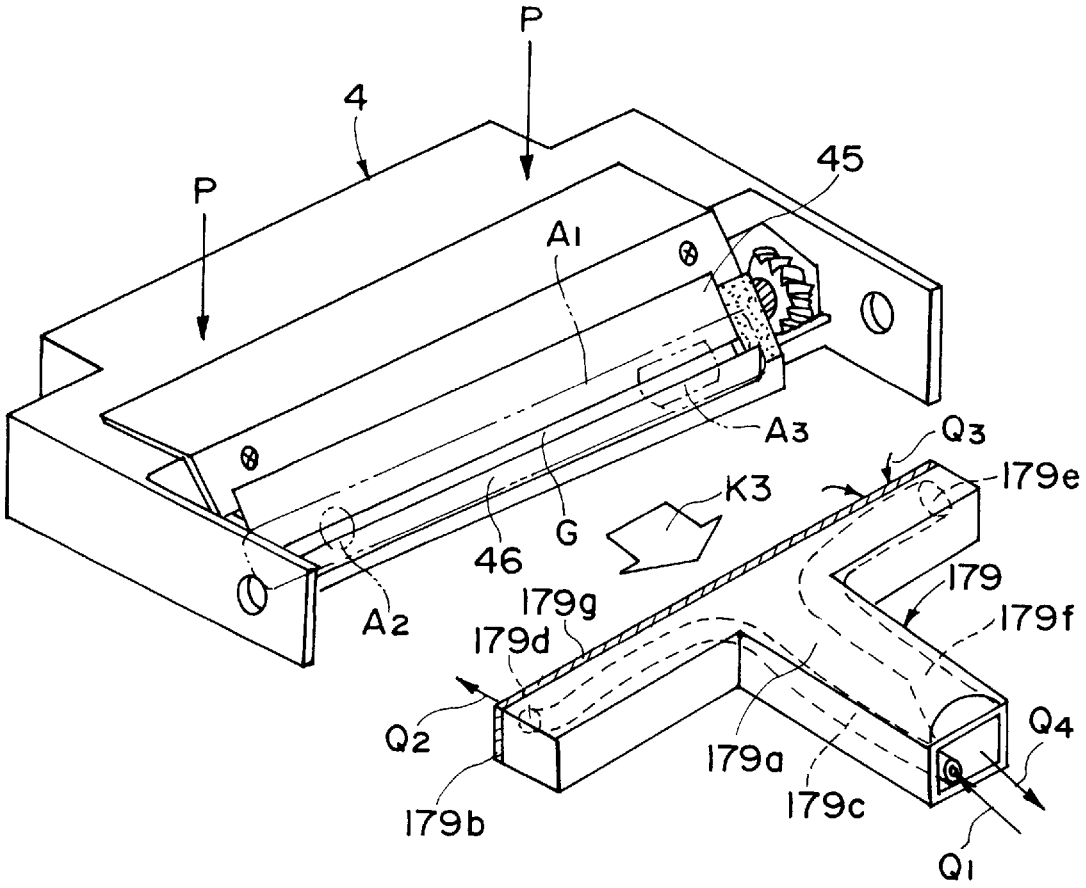
FIG. 26 is a perspective view of a sucking apparatus, and describes the operation thereof.

Referring to FIG. 22, the gap G located on the rear side of the cleaning unit 4 sitting on the receptacle table having been moved to the cleaning position M2 is covered with the air block 179*a* of a sucking apparatus 179. FIG. 26 is a detailed drawing of the air block 179*a*. The air block 179*a* is basically hollow, and a contact surface 179*g* facing the gap G of the cleaning unit 4 is mostly covered with a rubber-like sealing member 179*b*, except for a blowing opening 179*d* and a sucking opening 179*e*. Within the air block 179*a*, an air sending duct 179*c* for blowing the air into the cleaning unit 4 is disposed, and the blowing opening 179*d* of this air duct 179*c* opens near one end of the contact surface 179*g*. In addition, within the air block 179*a*, an air sucking duct 179*f* is disposed, and the sucking end opening 179*e* of the sucking duct 179*f* is disposed near the other end of the contact surface 179*g*. The contact surface 179*g*, at which this blowing opening 179*d* and sucking opening 179*e* open up, is moved in the direction of an arrow mark K3 by the aforementioned receptacle table 172, being thereby placed in contact with the cleaning blade 45 and scooping sheet 46 of the cleaning unit 4 having been moved to the cleaning position M2, so as to cover completely the gap G formed between the aforementioned two tips. The way the gap G is covered by the contact surface 179*g* is indicated by double dot lines A1, A2 and A3 in FIG. 26, wherein these double dot lines correspond to the contact surface 179*g*, blowing opening 179*d*, and sucking opening 179*e*. As is evident from the above description, the sucking apparatus 179 sends (Q2) compressed air supplied (Q1) from the base end side of the air sending duct 179*c*, into the cleaning unit 4 held air-tightly against the air block 179*a*, through blowing opening 179*d* placed air-tightly against A2 and the gap G, causing thereby the waste toner within the cleaning unit 4 to be air borne, and then, sucks out (Q3) the waste toner together with the air within the cleaning unit 4, through the sucking side opening 179*e* placed air-tightly against A3. The sucked out waste toner is sent out (Q4) toward the base side.

It should be noted here that the waste toner that leaks out of the cleaning unit 4 and air block 179*a* during this operation is sucked up together with the internal ambient air of the cleaning apparatus, by the auxiliary sucking apparatus (unillustrated) through the ventilating opening 178.

Next, referring mainly to FIG. 22, which depicts the structure of the cleaning apparatus 170, and a flow chart in FIG. 27, which shows the operational flow thereof, and also, to the other drawings as needed, a method for cleaning the cleaning unit 4 and the operation of the cleaning apparatus 170 will be described in detail.

At first, the cleaning apparatus 170 (cleaner) is started (S1). Then, the cleaning unit 4 as the object to be cleaned is placed on the top surface of the receptacle table 172 located at the home position M1 (S2). The cover 170*b* is closed (S3), which is detected by the detection sensor (door switch) 170*d* (S4), whereby the air cylinder is turned on (S5), and the cleaning unit 4 is clamped so as to be fixed at a predetermined location on the receptacle table 172 (S6). The air cylinder 175 is turned on (S7), whereby the receptacle table 172 is moved from the home position M1 to the cleaning position M2 (S8), placing thereby the gap G of the cleaning unit 4 air-tightly against the contact surface 179*g* of the sucking apparatus 179 (see FIG. 26). The motor 177*a* is turned on (S9), whereby the tapping apparatus 177 is activated to begin tapping the cleaning unit 4 by the projecting member 177*g* (S10). As a result, the waste toner clinging to the internal walls of the cleaning unit 4 is forced to fall so that the waste toner can be easily moved. The rotary actuator 176 is started (S11), whereby the oscillating table 173*a* of the oscillating apparatus 173 is oscillated once by 80° (S12). A compression air valve (unillustrated) of the sucking apparatus 179 is opened (S13, S14), whereby the air is blown into the cleaning unit 4 through the blowing opening 179*d* (FIG. 26) and gap G, and at the same time, the air within the cleaning unit 4 is sucked out together with the waste toner, through the gap G and sucking opening 179*e*. This is continued as needed to suck out completely the waste toner within the cleaning unit 4.

The oscillating table 173*a* is oscillated once more (S15). After the rotary actuator 176 is turned off (S16), and it is confirmed that the oscillating table 173*a* has been returned to the level position N1 (S17), the motor 177*a* is turned off (S18, S19), ending thereby the tapping of the cleaning unit 4 by the tapping apparatus 177. As the compression air valve is closed (S20, S21), and the air cylinder is turned on (S22), the receptacle table 172 having been at the cleaning position M2 is returned to the home position M1 (S23). Then, the air cylinder is turned off (S24), whereby the cleaning unit 4 having been clamped on the receptacle table is released (S25). Next, the cover 170*b* is opened (S26), and the cleaning unit 4 is taken out of the housing 170*a* (S27), ending the operation for cleaning the cleaning unit 4.

When the cleaning operation is continued to clean the next cleaning unit 4 (S28), the sequence goes back to S2, whereas when the cleaning operation is ended, the cleaning apparatus 170 is turned off (S29).

Figure 27:
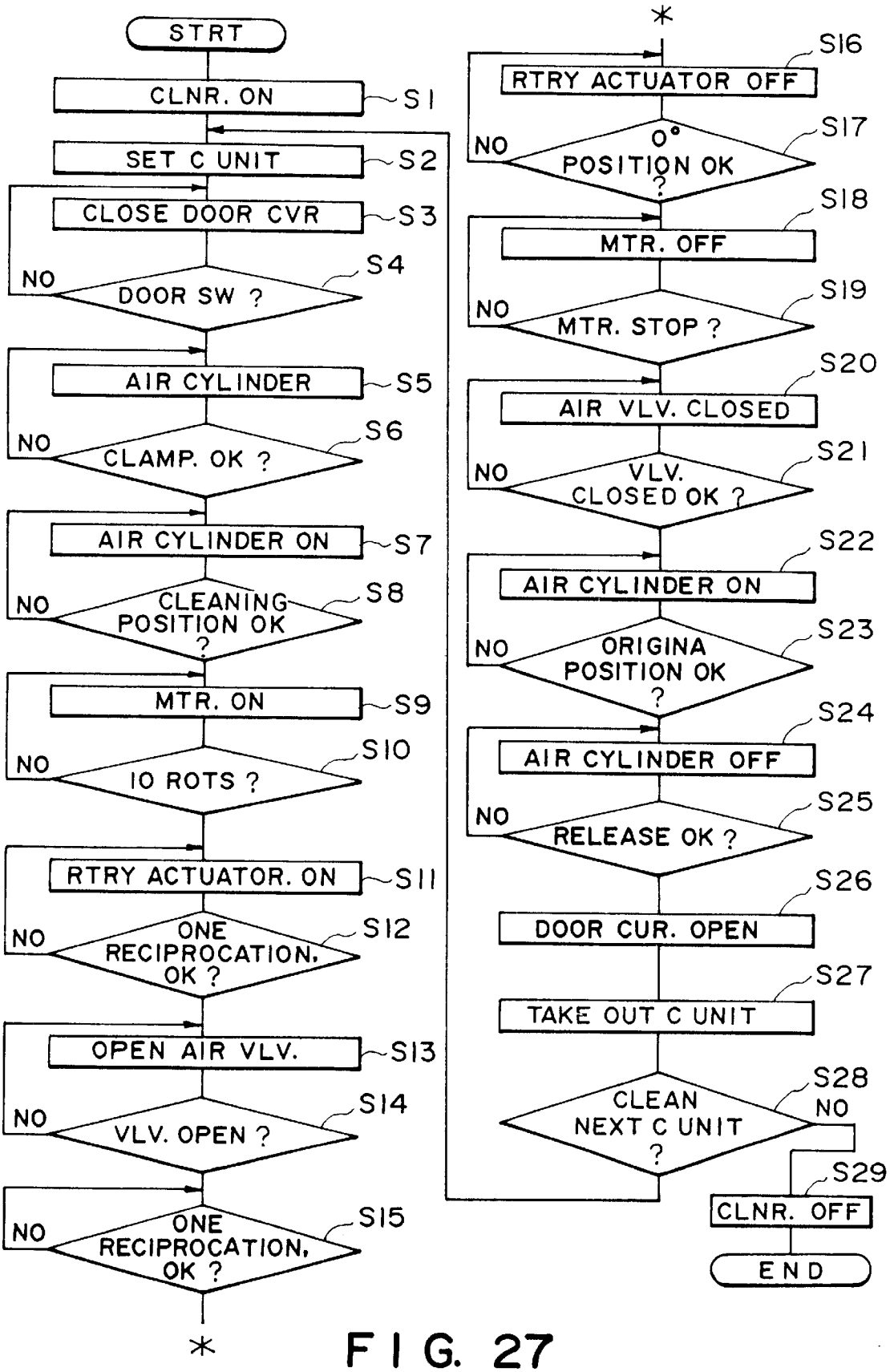
FIG. 27 is a flow chart showing the cleaning flow of the cleaning unit.

During the cleaning process described in the foregoing, the tapping of the cleaning unit 4 by the tapping apparatus 177 is continued from S9 to S18 of the flow chart given in FIG. 27, and the oscillating movement of the cleaning unit 4 and the waste toner suction are carried out in parallel with this continuous tapping. Therefore, the waste toner adhering to the internal walls or the like of the cleaning unit 4 is continuously tapped down, moved smoothly toward the gap G, blown by the compressed air blowing out of the blowing opening 179*d*, becoming thereby airborne, and sucked through the sucking opening 179*e*. In other words, these sequential operations can reliably extract the waste toner within the cleaning unit 4, leaving no toner therein.

Also during the cleaning operation described above, the number of oscillating operations of the oscillating table 173*a*, the duration of the sucking operation by the sucking apparatus 179, or the like may be optionally set based on the amount of the remaining waste toner, performance of the sucking apparatus, or the like factors.

In the cleaning operation represented by the flow chart given in FIG. 27, the steps S1–S4 are manually done by an operator, leaving the step S5–S25 to an automatic operation, and then, the rear end steps S26–S29 are again manually done. In other words, in the beginning portion, the operational sequence to be manually performed by the operator are those in the sequence from the first step to the step in which the cleaning unit 4 is mounted on the receptacle table 172 located at the home position M1, and, in the ending portion, the normal operation sequences are those in the sequence from the step in which the cleaned cleaning unit 4 is removed from the receptacle table located at the home positioned, to the last step.

There are no strict rules concerning, for example, which of the sequence of the cleaning steps shown in FIG. 27 are to be manually or automatically carried out during the cleaning of the cleaning unit 4. For example, all the steps may be manually carried out as depicted by the perspective view in FIG. 28. In this case, the cleaning unit 4 is fixed on an appropriate table, and then, the sucking nozzle 180 of a sucking apparatus (unillustrated) is held by a hand so as for the sucking opening 180*a* thereof to be pressed against the gap G of the cleaning unit 4. Then, the toner within the cleaning unit 4 is sucked as the sucking opening 180*a* is horizontally moved along the gap G while tapping the top surface of the cleaning unit 4, at the portions indicated by arrow marks P and P.

At this time, when the sucking operation is carried out while rotating the gear 47*a* exposed near the one end of cleaning unit 4, in the direction of an arrow mark R3 (while carrying out the toner moving step), the waste toner can be extracted with a higher efficiency. More specifically, the gear 47*a* is engaged with a gear (unillustrated) fixed on the waste toner delivery member designated by a reference numeral 47; therefore, as the gear 47*a* is rotated in the arrow mark R3 direction, the waste toner delivery member 47 illustrated in FIG. 1 is rotated in the counterclockwise direction of the same drawing, whereby the waste toner having settled at the bottom of the waste toner storage can be consecutively moved toward the gap G.

Figure 28:
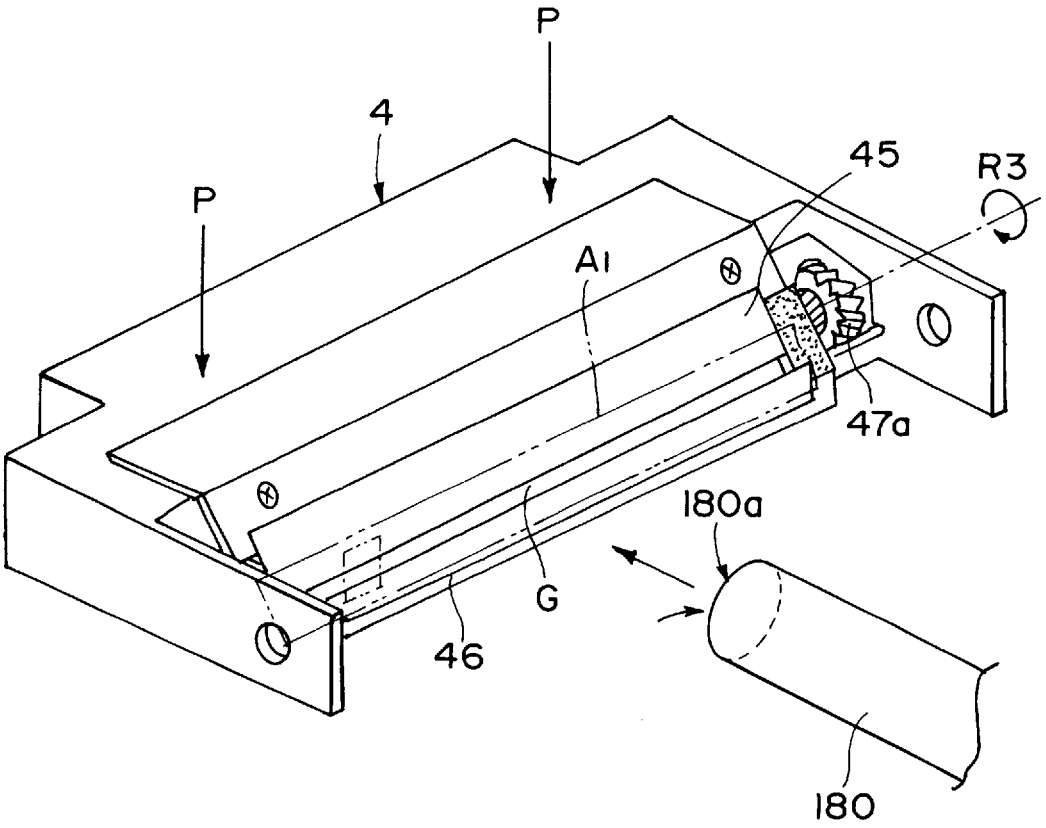
FIG. 28 is a perspective view of another embodiment of sucking apparatus according to the present invention.

In the case of a partially manual, that is, the so-called semi-automatic cleaning apparatus such as the one 170 illustrated in FIG. 22, it is unnecessary to rotate manually the gear 47*a* illustrated in FIG. 28. This is because the cleaning apparatus 170 comprises, as described before, the built-in oscillating apparatus 173 as the replacement of the gear 47*a*, and as the cleaning unit 4 is oscillated by the oscillating apparatus 173, the waste toner is moved toward the gap G with a better efficiency than as the waste toner delivery member 47.

Figure 29:
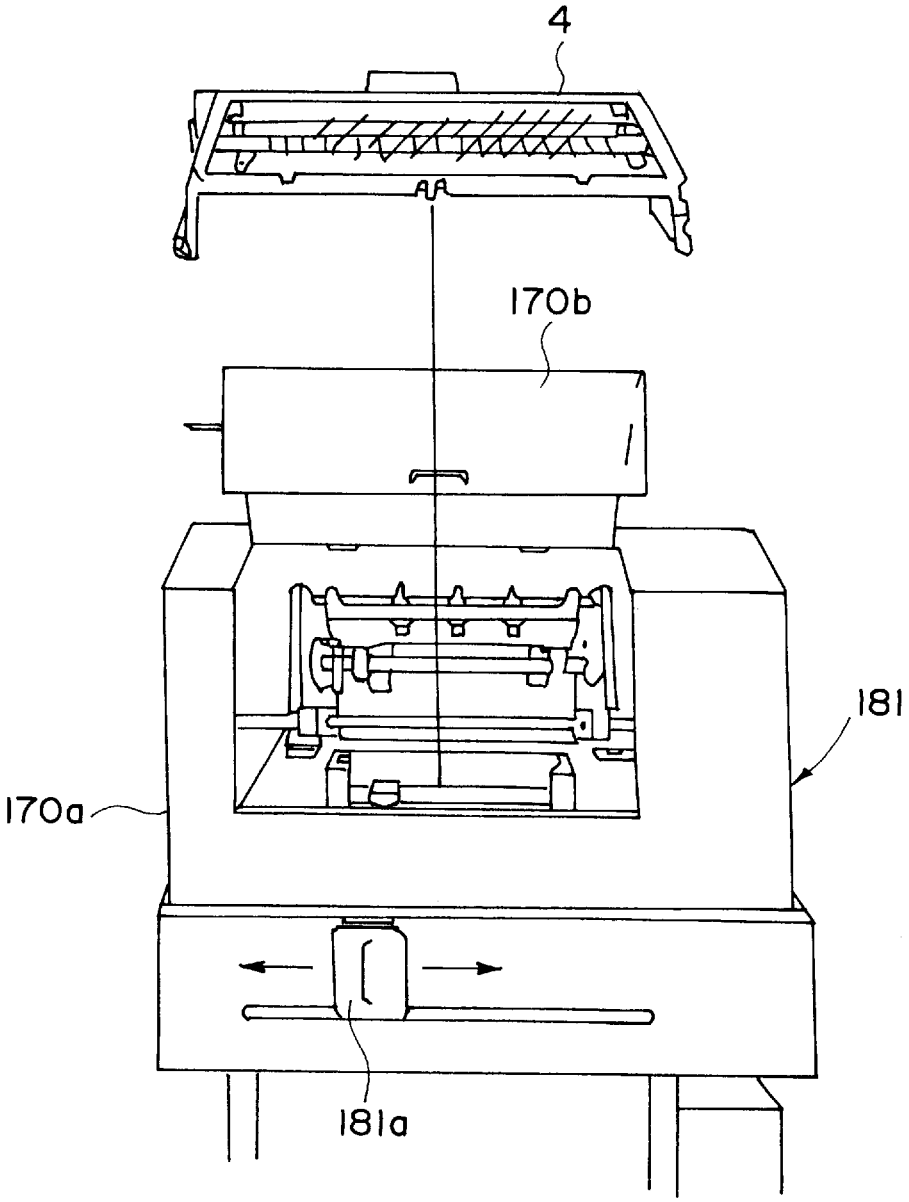
FIG. 29 is a perspective view of another embodiment of cleaning apparatus of the cleaning unit according to the present invention.

Also, such a cleaning apparatus 181 as shown in FIG. 29 may be employed. The cleaning apparatus 181 comprises a housing 70*a* and a cover 170*b*, and its basic structure is substantially similar to that of the cleaning apparatus 170 illustrated in FIG. 22. The difference is in that in the case of the cleaning apparatus 181 of FIG. 29, the sucking opening (unillustrated) for sucking the waste toner within the cleaning unit 4 is manually moved. As a shifter knob 181*a* is horizontally moved, the sucking opening integral with the shifter knob 181*a* is moved along the gap G of the cleaning unit 4, sucking up the waste toner therein.

After the toner is extracted from the cleaning unit 4, the cleaning blade 45 and scooping sheet 46 are removed from the cleaning unit 4. Then, the interior of the waste toner storage 49 is cleaned by air or the like, and the used cleaning blade 45 and used scooping sheet 46 are replaced with new ones.

Figure 30:
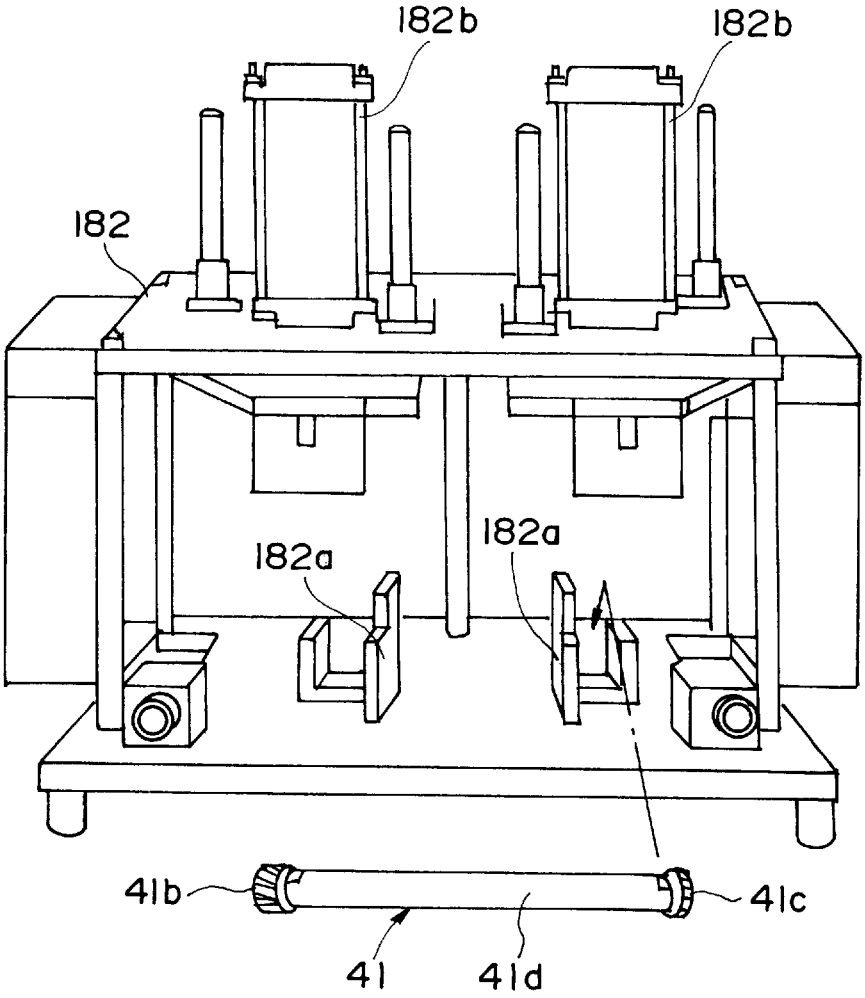
FIG. 30 is a perspective view of a pressing apparatus employed for disassembling the photosensitive drum.

On the other hand, the photosensitive drum 41 is disassembled into a smaller components using a pressing apparatus 182 illustrated in FIG. 30. More specifically, the drum cylinder 41*d* is set on jigs 182*a* and 182*a* of the pressing apparatus 182 in such a manner that the driving gear 41*b* (in this embodiment, a helical gear is used as the driving gear so that the position of the photosensitive drum 41 is easily and reliably fixed by being pressed in the thrust direction as the driving force is transmitted to the photosensitive drum 41) mounted at one end and the flange gear 41*c* mounted at the other end stick out leftward and rightward, respectively. Next, the driving gear 41*b* and flange gear 41*c* are held between vertically movable members 182*b* and 182*b*, and jigs 182*a* and 182*a* of the pressing apparatus 182, and these gears are disengaged from the drum cylinder 41*d*. These gears are not recycled as is, but are recycled as production material after they are separated into a group of metallic members such as the drum cylinder 41 and a group of resin material members such as the driving gear 41*b* and flange gear 41*c*.

After the waste toner extraction, cleaning, replacement of the cleaning blade 45 and scooping sheet 46, a new photosensitive drum 41 and a cleaned protective plate 43 are attached to the waste toner storage 49 to reconstruct the cleaning unit 4. At this time, it is necessary to attach the cleaning blade 45 to the photosensitive drum 41 with a predetermined degree of accuracy. Since both components are mounted on the common frame constituting the waste toner storage 49, that is, their positions are fixed by the common frame, it is easier to assure the positional accuracy. It should be noted here that even the basically recyclable members such as the protective plate, to begin with, are replaced with new members as needed when their performances and specifications do not meet the predetermined standards after the cleaning or the like procedure.

Next, following in reverse order of the disassembling steps for the process cartridge C, which were described with reference to FIGS. 3–7, the process cartridge C is reconstructed by mounting the developing unit 3, primary charging unit 2, and top frame 1, on the cleaning unit 4. More specifically, the developing unit 3 is joined with the cleaning unit 4 (FIG. 7); the tension spring 41*a* for pressing the developing roller 33 toward the photosensitive drum 41 is attached (FIG. 6); the primary charging unit 2 is mounted on the top surface of the cleaning unit 4 (FIG. 5); and lastly, the top frame 1 is lowered from above to cover the cleaning unit 4, developing unit 3, and primary charging unit 2, which have been united through the assembly sequence described above, and is fixed with pins 12 (FIG. 3). During this assembly, the positions of the charge wire 22 of the primary charging unit 2, and the developing roller 33 of the developing unit 3, which must be mounted with a predetermined degree of the positional accuracy relative to the photosensitive drum 41, are fixed by the spacer, which makes contact with the photosensitive drum 41, on the peripheral surface, outside the image forming region; therefore, the required positional accuracy can be simply secured just by reconstructing the process cartridge C following the aforementioned assembly order.

With the use of the reconstructing method described in the foregoing, a process cartridge C (FIG. 1) can be remanufactured to display substantially the same performance as a brand new process cartridge C constructed using nothing but new components; therefore, the remanufacturing method according to the present invention can contribute to the preservation of natural resources.

The reconstructed process cartridge C is installed in the laser beam printer 50 illustrated in FIG. 2, in the same manner as a brand new one, to be used for image formation just like when it was a brand new one.

Figure 31:
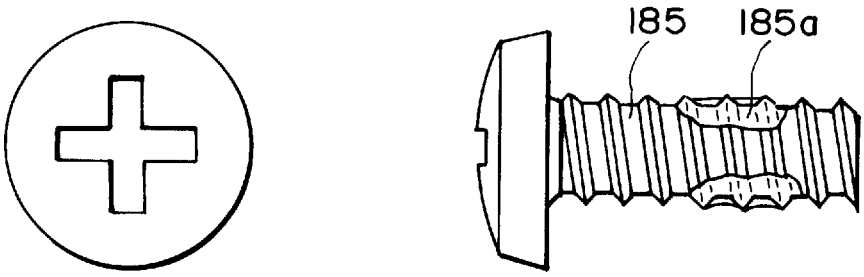
FIG. 31 gives a front view and a side view of a screw devised for locking (locking screw).

The T frame 31, waste toner storage 49, and the like are made of resin material, and when a process cartridge C is constructed, the cleaning blade 45, for example, is attached to this waste toner storage 49 using a self-tapping screw. If the original self-tapping screw is removed and reused when the cleaning blade 34 is replaced, it is liable to loosen itself. Therefore, the original self-tapping screw is replaced with a new screw 185 called "nylon lock" (commercial name), such as the one illustrated in FIG. 31, which has a resin portion 185*a* located in the middle of the threaded portion. With this screw replacement, even when the screw 185 is screwed into the original screw hole with female threads cut by the self-tapping screw, the screw 185 can be effectively prevented from loosening itself.

{Other Structures of Processing Means}

As for a developing method that the aforementioned process cartridge according to the present invention is compatible with various well-known methods such as the double component magnetic brush developing method, cascade developing method, touch down developing method, cloud developing method, and the like may be employed.

As for the image bearing member to which the present invention is applicable, it is not limited to the aforementioned photosensitive drum. The present invention is also applicable to the following. To begin with, the photoconductive material is usable as the photosensitive material. As for the photoconductive material, amorphous silicon, amorphous selenium, zinc oxide, titanium oxide, organic photoconductor, or the like, is usable. Further, as for the configuration of a base member on which the photosensitive material is placed, it may be in the form of a rotary member such as a drum, or may be in the form of a sheet such as a belt or the like. Generally speaking, a base member in the form of a drum or a belt is used. For example, in the case of the base member of the drum type, the photoconductive material is coated, deposited, or placed by the like means on a cylinder of aluminum alloy or the like.

Further, as to the structure of the charging means, a so-called corona type charger is employed in the aforementioned embodiment, but the so-called contact charging method, for example, which has a different structure, may be employed. This type of charging roller comprises: a metallic roller shaft; an electrically conductive elastic layer laminated on the roller shaft; an electrically highly resistive elastic layer laminated on the first elastic layer; and a protective film laminated on the second elastic layer. The electrically conductive elastic layer functions to lead the bias voltage to be supplied to the roller shaft. The highly resistive elastic layer regulates the leakage current to the photosensitive drum, and thereby prevents the bias voltage from dropping suddenly. The protective layer prevents the plastic material of the electrically conductive elastic layer or highly resistive layer from coming in contact with the photosensitive drum and changing the surface properties thereof. The charging roller is rotatively mounted in contact with the photosensitive drum so as to be rotated by the rotation of the photosensitive drum, the surface of which is uniformly charged as the charge bias is applied to this charging roller.

Further, the aforementioned charging means may be of the blade type, (charging blade), pad type, block type, rod type, wire type, or the like, in addition to the roller type described previously.

As for the method for cleaning the residual toner on the photosensitive drum, the cleaning means may be constituted of a blade, fur brush, magnetic brush, or the like.

{Various Combinations between New and Recycled Components for Cartridge Remanufacture}

According to the present invention, at least the T-D frame and photosensitive drum are replaced with new ones during the process cartridge remanufacture, but the other components are reused when they meet the predetermined standards through the inspections after cleaning, and are replaced with the new ones when not. At this time, even normally reusable components might be replaced with the new ones depending on the type of component combinations among the reusable components.

(1) During the process cartridge remanufacture, the T-D frame and photosensitive drum are replaced with new ones without inspecting the used ones. More specifically, when a process cartridge is remanufactured, a recycled developing roller is mounted on a new T-D frame, and a new photosensitive drum, a recycled elastic cleaning blade, and a recycled charging roller are mounted on a recycled drum frame.

In this case, the use of a new T-D frame makes it easier and more reliable to seal the T frame as described before, and the use of a new photosensitive drum enables even a reconstructed process cartridge to produce an image with exactly the same quality as a brand new cartridge. As for the other components, the use of recycled components contributes to the preservation of natural resources.

(2) In addition to the T-D frame and photosensitive drum, the cleaning blade is also replaced with a new one without inspecting the used one during the process cartridge remanufacture. More specifically, a recycled developing roller is mounted on a new T-D frame, and a new photosensitive drum, a new elastic cleaning blade, and a recycled corona charger are mounted on a recycled drum frame during the process cartridge remanufacture.

The cleaning blade is constantly in contact with the photosensitive drum, being liable to be worn as it rubs against the rotating photosensitive drum. Therefore, a cleaning blade, which has been found out, through the inspection during the research and development process, to display a high probability that it must be replaced during the remanufacture, may be replaced with a new one without being inspected during the remanufacture. Such an arrangement allows a process for inspecting the cleaning blade to be omitted, improving thereby the cartridge remanufacture efficiency. It is needless to say that when there is a high probability that a cleaning blade will be found out to be reusable after the inspection, a policy to reuse it is preferable, and such a policy will further contribute to the preservation of natural resources.

(3) In addition to the T-D frame and photosensitive drum, the cleaning blade and developing roller also are replaced with new ones during the process cartridge remanufacture. More specifically, a new developing roller is mounted on a new T-D frame, and a new photosensitive drum, a new elastic cleaning blade, and a recycled charging roller are mounted on a recycled drum frame during the process cartridge manufacture.

The developing roller also is liable to be worn as it rubs against the developing blade. Therefore, when it is found out, through the inspection conducted during the research and development process, that a developing roller displays a high probability that it will need replacement, replacing it with a new one without inspection during the process cartridge remanufacture improves the operational efficiency.

As for the type of the aforementioned process cartridge, the following can be listed in addition to the one described in the preceding embodiment.

To begin with, there are those in which charging means, developing means, and/or cleaning means, as processing means, and an electro-photographic photosensitive member as an image bearing member, are integrated into a form of cartridge, which can be removably installed in an image forming apparatus.

Also, there are those in which at least one of the charging means, developing means, and cleaning means, as processing means, and an electro-photographic photosensitive member as the image bearing member, are integrated into a form of cartridge, which is removably installed into the image forming apparatus.

Further, there are those in which at least the developing means as the processing means and the electro-photographic photosensitive member as the image bearing member are integrated into a form of cartridge, which is removably installed into the image forming apparatus.

As for the types of the aforementioned image forming apparatus, there are the laser beam printer, to begin with, illustrated in FIG. 2, and the other ones, such as electro-photographic copying machines and facsimiles.

In this specification, a terminology "new component" (for example, photosensitive drum, T frame, D frame, and the like) includes those molded of the recycled material produced by melting the recovered components, in addition to brand new ones.

The "recycled components" means such components that are taken out of used cartridges recovered from the market or the like, and repeatedly put to use as they are. Further, they are those which are cleaned, inspected and assured for satisfactory performance before reuse. In addition, they include those which have been re-processed (for example, cutting, polishing, grinding, coating with solvent), as needed, to recover their original performance.

As for the inspection, it includes visual inspection by an inspector, and also, inspection using apparatuses as needed.

As described hereinbefore, according to the present invention, reusable members are recycled to remanufacture the process cartridge; therefore, it can contribute to the preservation of natural resources. During this remanufacture, at least the T-D frame and photosensitive drum are replaced with new ones; therefore, the opening of the T frame, which comprises the toner storing portion, can be easily and reliably sealed. Further, since the T-D frame is replaced with a new one produced by joining new components by welding, its seam is strong enough to prevent the occurrence of toner leak.

Further, a reconstructed process cartridge can also provide the same image quality as a brand new cartridge.

Depending on the types of combinations among the components, the cleaning blade or developing roller, or both of them, may be replaced during the cartridge remanufacture. Such replacement allows the elimination of the inspection thereof; therefore, the operational efficiency in the remanufacture can be improved.

While the invention has been described with reference to the structures disclosed herein, it is not confined to the details set forth and this application is intended to cover such modifications or changes as may come within the purposes of the improvements or the scope of the following claims.

What is claimed is:

1. A process cartridge remanufacturing method for a process cartridge detachably mountable to a main assembly of an image forming apparatus, said method comprising the steps of:

providing a new photosensitive drum;

providing a new toner-development frame including a new toner frame having a toner containing portion for containing toner, the toner containing portion having a toner supply opening, and a new development frame having a roller mounting portion for mounting a developing roller for supplying toner from the toner containing portion to the new photosensitive drum to develop a latent image formed on the new photosensitive drum, wherein the new toner frame and the new development frame are welded with a new removable toner seal therebetween for preventing toner in the toner containing portion from leaking out, and wherein the new toner seal is removed from between the new toner frame and the new development frame prior to start of use of the process cartridge;

preparing a drum frame to be reused having a drum mounting portion for mounting the new photosensitive drum, the drum frame having passed inspection;

supplying toner into the toner containing portion through the toner supply opening;

mounting the developing roller to the new development frame;

mounting the new photosensitive drum to the drum frame to be reused; and engaging the new toner-development frame and the drum frame to be reused such that the new toner-development frame is rotatable relative to the drum frame;

wherein when the process cartridge is remanufactured, a used toner-development frame is exchanged with said new toner-development frame in which a new toner seal is interposed between the new toner frame and the new development frame without inspecting whether the used toner-development frame is reusable or not.

2. A method according to claim 1, wherein the drum frame to be reused is provided with an elastic cleaning blade for removing residual toner deposited on the new photosensitive drum during an image forming operation.

3. A method according to claim 2, wherein the elastic cleaning blade is new.

4. A method according to claim 2, wherein the elastic cleaning blade is a used and cleaned one.

5. A method according to claim 1, wherein the developing roller is a new one.

6. A method according to claim 1, wherein the developing roller is a used and cleaned one.

7. A method according to claim 1, wherein a used and cleaned charging means for charging the new photosensitive drum during an image forming operation is mounted to the drum frame to be reused after the drum frame to be reused is cleaned.

8. A method according to claim 7, wherein the charging means includes a corona charger having a corona wire.

9. A method according to claim 7, wherein the charging means includes a charging roller.

10. A method according to claim 1, wherein a used and cleaned developing roller is mounted to the new development frame; and the new photosensitive drum, a new elastic cleaning blade, and a used and cleaned corona charger are mounted to the drum frame to be reused after the drum frame to be reused is cleaned.

11. A method according to claim 1, wherein a new developing roller is mounted to the new development frame; and the new photosensitive drum, a new elastic cleaning blade, and a used and cleaned charging roller are mounted to the drum frame to be reused after the drum frame to be reused is cleaned.

12. A method according to claim 1, wherein a used and cleaned developing roller is mounted to the new development frame; and the new photosensitive drum, a used and cleaned elastic cleaning blade, and a used and cleaned charging roller are mounted to the drum frame to be reused after the drum frame to be reused is cleaned.

13. A method according to claim 1, wherein the new photosensitive drum has an organic photosensitive layer on an outer surface thereof, and a helical gear at an end thereof.

14. A method according to any one of claims 1, 2, 5–7, or 10–13, wherein the new toner-development frame includes the new toner frame and the new development frame with the new toner seal therebetween, and wherein the new toner frame and the new development frame are welded by ultrasonic wave.

15. A method according to claim 14, wherein the new toner seal is provided on a plate of plastic material having an opening for permitting toner in the toner containing portion to pass so as to close the opening, and wherein the new toner seal is removable.

16. A method according to claim 15, wherein the new toner seal is mounted to the plate by heat sealing, and the plate is mounted to the new toner frame by ultrasonic wave welding.

17. A process cartridge detachably mountable to a main assembly of an image forming apparatus, said process cartridge comprising:

a new photosensitive drum;

a new toner-development frame including a new toner frame having a toner containing portion for containing toner, said toner containing portion having a toner supply opening, a new development frame having a roller mounting portion for mounting a developing roller for supplying toner from said toner containing portion to said new photosensitive drum to develop a latent image formed on said new photosensitive drum, wherein said new toner frame and said new development frame are welded with a new removable toner seal therebetween for preventing the toner in said toner containing portion from leaking out, wherein said new toner seal is removed from between said new toner frame and said new development frame prior to start of use of said process cartridge;

a reusable drum frame to be reused having a drum mounting portion to which said new photosensitive drum is mounted, said reusable drum frame having passed inspection; and a developing roller mounted to said new development frame, wherein toner is supplied into said toner containing portion through said toner supply opening;

wherein when the process cartridge is remanufactured, a used toner-development frame is exchanged with said new toner-development frame in which a new toner seal is interposed between the new toner frame and the new development frame without inspecting whether the used toner-development frame is reusable or not.

18. A process cartridge according to claim 17, wherein said drum frame to be reused is provided with an elastic cleaning blade for removing residual toner deposited on said new photosensitive drum during an image forming operation.

19. A process cartridge according to claim 18, wherein said elastic cleaning blade is new.

20. A process cartridge according to claim 18, wherein said elastic cleaning blade is a used and cleaned one.

21. A process cartridge according to claim 17, wherein said developing roller is a new one.

22. A process cartridge according to claim 21, wherein said developing roller is a used and cleaned one.

23. A process cartridge according to claim 17, wherein a used and cleaned charging means for charging said new photosensitive drum during an image forming operation is mounted to said drum frame to be reused after said drum frame to be reused is cleaned.

24. A process cartridge according to claim 23, wherein said charging means includes a corona charger having corona wire.

25. A process cartridge according to claim 23, wherein said charging means includes a charging roller.

26. A process cartridge according to claim 17, wherein a used and cleaned developing roller is mounted to said new development frame; and said new photosensitive drum, a new elastic cleaning blade, and a used and cleaned corona charger are mounted to said drum frame to be reused after said drum frame to be reused is cleaned.

27. A process cartridge according to claim 17, wherein a new developing roller is mounted to said new development frame; and said new photosensitive drum, a new elastic cleaning blade, and a used and cleaned charging roller are mounted to said drum frame to be reused after said drum frame to be reused is cleaned.

28. A process cartridge according to claim 17, wherein a used and cleaned developing roller is mounted to said new development frame; and said new photosensitive drum, a used and cleaned elastic cleaning blade, and a used and cleaned charging roller are mounted to said drum frame to be reused after said drum frame to be reused is cleaned.

29. A process cartridge according to claim 17, wherein said new photosensitive drum has an organic photosensitive layer on an outer surface thereof, and a helical gear at an end thereof.

30. A process cartridge according to any one of claims 17, 18, 21–23, or 26–29, wherein said new toner-development frame includes said new toner frame and said new development frame with said new toner seal therebetween, wherein said new toner frame and said new development frame are welded by ultrasonic wave.

31. A process cartridge according to claim 30, wherein said new toner seal is provided on a plate of plastic material having an opening for permitting toner in said toner containing portion to pass so as to close the opening, and wherein said new toner seal is removable.

32. A process cartridge according to claim 31, wherein said new toner seal is mounted to said plate by heat sealing, and said plate is mounted to said new toner frame by ultrasonic wave welding.

33. A process cartridge remanufacturing method for a process cartridge detachably mountable to a main assembly of an image forming apparatus, said method comprising the steps of:

providing a new photosensitive drum;

providing a new toner-development frame including a new toner frame having a toner containing portion for containing toner, the toner containing portion having a toner supply opening, and a new development frame having a roller mounting portion for mounting a developing roller, which is one of a new developing roller and a used and cleaned developing roller, for supplying toner from the toner containing portion to the new photosensitive drum to develop a latent image formed on the new photosensitive drum, wherein the new toner frame and the new development frame are welded with a new removable toner seal therebetween for preventing toner in the toner containing portion from leaking out, and wherein the new toner seal is removed from between the new toner frame and the new development frame prior to start of use of the process cartridge;

preparing a drum frame, which has passed inspection, to be reused, the drum frame having a drum mounting portion for mounting the new photosensitive drum, and being provided with an elastic cleaning blade, which is one of a new elastic cleaning blade and a used and cleaned elastic cleaning blade, for removing residual toner deposited on the new photosensitive drum during an image forming operation;

supplying toner into the toner containing portion through the toner supply opening;

mounting the developing roller to the new development frame;

mounting the new photosensitive drum to the drum frame to be reused; and engaging the new toner-development frame and the drum frame to be reused such that the new toner-development frame is rotatable relative to the drum frame, wherein a used and cleaned photosensitive drum charger, which is one of a charging roller and a corona charger, is mounted to the drum frame to be reused after the drum frame to be reused is cleaned;

wherein when the process cartridge is remanufactured, a used toner-development frame is exchanged with the new toner-development frame in which a new toner seal is interposed between the new toner frame and the new development frame without inspecting whether the used toner-development frame is reusable or not.

34. A method according to claim 33, wherein the elastic cleaning blade is new.

35. A method according to claim 33, wherein the developing roller is a new one.

36. A method according to claim 33, wherein the charger includes a corona charger having a corona wire.

37. A method according to claim 33, wherein a used and cleaned developing roller is mounted to the new development frame; and the new photosensitive drum, a new elastic cleaning blade, and a used and cleaned corona charger are mounted to the drum frame to be reused after the drum frame to be reused is cleaned.

38. A method according to claim 33, wherein a new developing roller is mounted to the new development frame; and the new photosensitive drum, a new elastic cleaning blade, and a used and cleaned charging roller are mounted to the drum frame to be reused after the drum frame to be reused is cleaned.

39. A method according to claim 33, wherein a used and cleaned developing roller is mounted to the new development frame; and the new photosensitive drum, a used and cleaned elastic cleaning blade, and a used and cleaned charging roller are mounted to the drum frame to be reused after the drum frame to be reused is cleaned.

40. A method according to claim 33, wherein the new photosensitive drum has an organic photosensitive layer on an outer surface thereof, and a helical gear at an end thereof.

41. A method according to any one of claims 33, 35, or 37–40, wherein the new toner-development frame includes the new toner frame and the new development frame with the new toner seal therebetween, and wherein the new toner frame and the new development frame are welded by ultrasonic wave.

42. A method according to claim 41, wherein the new toner seal is provided on a plate of plastic material having an opening for permitting toner in the toner containing portion to pass so as to close the opening, and wherein the new toner seal is removable.

43. A method according to claim 42, wherein the new toner seal is mounted to the plate by heat sealing, and the plate is mounted to the new toner frame by ultrasonic wave welding.

44. A process cartridge detachably mountable to a main assembly of an image forming apparatus, said process cartridge comprising:

a new photosensitive drum;

a new toner-development frame including a new toner frame having a toner containing portion for containing toner, said toner containing portion having a toner supply opening, a new development frame having a roller mounting portion for mounting a developing roller, which is one of a new developing roller and a used and cleaned developing roller, for supplying toner from said toner containing portion to said new photosensitive drum to develop a latent image formed on said new photosensitive drum, wherein said new toner frame and said new development frame are welded with a new removable toner seal therebetween for preventing the toner in said toner containing portion from leaking out, wherein said new toner seal is removed from between said new toner frame and said new development frame prior to start of use of said process cartridge;

a reusable drum frame, which has passed inspection, to be reused, said reusable drum frame having a drum mounting portion to which said new photosensitive drum is mounted, and being provided with an elastic cleaning blade, which is one of a new elastic cleaning blade and a used and cleaned elastic cleaning blade, for removing residual toner deposited on said new photosensitive drum during an image forming operation; and a developing roller mounted to said new development frame, wherein toner is supplied into said toner containing portion through said toner supply opening, and wherein a used and cleaned photosensitive drum charger, which is one of a charging roller and a corona charger, is mounted to said drum frame to be reused after said drum frame to be reused is cleaned;

wherein when the process cartridge is remanufactured, a used toner-development frame is exchanged with said new toner-development frame in which a new toner seal is interposed between the new toner frame and the new development frame without inspecting whether the used toner-development frame is reusable or not.

45. A process cartridge according to claim 44, wherein said elastic cleaning blade is new.

46. A process cartridge according to claim 44, wherein said developing roller is a new one.

47. A process cartridge according to claim 44, wherein said charger includes a corona charger having a corona wire.

48. A process cartridge according to claim 44, wherein a used and cleaned developing roller is mounted to said new development frame; and said new photosensitive drum, a new elastic cleaning blade, and a used and cleaned corona charger are mounted to said drum frame to be reused after said drum frame to be reused is cleaned.

49. A process cartridge according to claim 44, wherein a new developing roller is mounted to said new development frame; and said new photosensitive drum, a new elastic cleaning blade, and a used and cleaned charging roller are mounted to said drum frame to be reused after said drum frame to be reused is cleaned.

50. A process cartridge according to claim 44, wherein a used and cleaned developing roller is mounted to said new development frame; and said new photosensitive drum, a used and cleaned elastic cleaning blade, and a used and cleaned charging roller are mounted to said drum frame to be reused after said drum frame to be reused is cleaned.

51. A process cartridge according to claim 44, wherein said new photosensitive drum has an organic photosensitive layer on an outer surface thereof, and a helical gear at an end thereof.

52. A process cartridge according to any one of claims 44, 46, or 48–51, wherein said new toner-development frame includes said new toner frame and said new development frame with said new toner seal therebetween, wherein said new toner frame and said new development frame are welded by ultrasonic wave.

53. A process cartridge according to claim 52, wherein said new toner seal is provided on a plate of plastic material having an opening for permitting toner in said toner containing portion to pass so as to close the opening, and wherein said new toner seal is removable.

54. A process cartridge according to claim 53, wherein said new toner seal is mounted to said plate by heat sealing, and said plate is mounted to said new toner frame by ultrasonic wave welding.

* * * * *

UNITED STATES PATENT AND TRADEMARK OFFICE

CERTIFICATE OF CORRECTION

PATENT NO. : 5,870,654

DATED : February 9, 1999

INVENTOR(S) : MINORU SATO, ET AL.

It is certified that error appears in the above-identified patent and that said Letters Patent is hereby corrected as shown below:

COVER PAGE [56] U.S. PATENT DOCUMENTS,
Insert, --5,543,898 8/1996 Shishido et al.--, and
--5,500,714 3/1996 Yashiro et al.--.

COLUMN 1,
Line 61, "provided" should read --provide--.

COLUMN 3,
Line 7, "FIG." should read --FIGS.--.

COLUMN 6,
Line 55, "lift" should read --lifted--.

COLUMN 9,
Line 50, "have" should read --has--.

COLUMN 12,
Line 67, "includes" should read --include--.

COLUMN 16,
Line 46, "positioned," should read --position,--.

UNITED STATES PATENT AND TRADEMARK OFFICE

CERTIFICATE OF CORRECTION

PATENT NO. : 5,870,654

DATED : February 9, 1999

INVENTOR(S) : MINORU SATO, ET AL.

It is certified that error appears in the above-identified patent and that said Letters Patent is hereby corrected as shown below:

COLUMN 17,
Line 20, "70a" should read --170a--.
Line 36, "a" (1st occurrence) should be deleted.

COLUMN 18,
Line 57, "with" should read --with,--.

Signed and Sealed this

Eleventh Day of April, 2000

*Attest:*

Q. TODD DICKINSON

*Attesting Officer*

*Director of Patents and Trademarks*